US008111587B2

(12) United States Patent
Watanabe

(10) Patent No.: US 8,111,587 B2
(45) Date of Patent: Feb. 7, 2012

(54) WATCH WITH CALENDAR MECHANISM EQUIPPED WITH MONTH INDICATOR AND DATE INDICATOR

(75) Inventor: Mamoru Watanabe, Chiba (JP)

(73) Assignee: Seiko Instruments Inc. (JP)

( * ) Notice: Subject to any disclaimer, the term of this patent is extended or adjusted under 35 U.S.C. 154(b) by 147 days.

(21) Appl. No.: 12/592,429

(22) Filed: Nov. 24, 2009

(65) Prior Publication Data

US 2010/0135125 A1 Jun. 3, 2010

(30) Foreign Application Priority Data

Nov. 28, 2008 (JP) ..... 2008-304425

(51) Int. Cl.
*G04B 19/24* (2006.01)

(52) U.S. Cl. ..... 368/37; 368/38

(58) Field of Classification Search ..... 368/28, 368/34–38

See application file for complete search history.

(56) References Cited

U.S. PATENT DOCUMENTS 4,228,644 A 10/1980 Watanabe et al. ..... 368/28
7,027,360 B2 * 4/2006 Kitahara et al. ..... 368/28
7,301,854 B2 * 11/2007 Ruefenacht ..... 368/37
2006/0120219 A1 6/2006 Ruefenacht ..... 368/37
2006/0221773 A1 * 10/2006 Kuepfer et al. ..... 368/37
2007/0109916 A1 * 5/2007 Bron ..... 368/35
2008/0094941 A1 * 4/2008 Pellaton ..... 368/37
2009/0129207 A1 * 5/2009 Watanabe ..... 368/37

OTHER PUBLICATIONS

Patent Abstracts of Japan, Publication No. JP2005195370, Publication Date Jul. 21, 2005.
Patent Abstracts of Japan, Publication No. JP63313089, Publication Date Dec. 21, 1988.

* cited by examiner

*Primary Examiner* — Sean Kayes
(74) *Attorney, Agent, or Firm* — Adams & Wilks

(57) ABSTRACT

The present invention aims to provide a watch with a calendar mechanism which allows a reduction in the thickness of a date feeding mechanism and a month feeding mechanism. In a watch with a calendar mechanism according to the present invention, a date indicator includes a month end tooth for driving a month feeding lever at the end of a month and feeding the date indicator at the end of a shorter month. A month indicator includes a month cam for operating a shorter month end feeding lever at the end of a shorter month. The shorter month end feeding lever can feed the date indicator by one day based on the rotation of a date indicator driving wheel and the rotation of the month cam. The month feeding lever moves toward the month indicator at the end of a month based on the rotation of the date indicator, and can feed the month indicator by one month.

8 Claims, 33 Drawing Sheets

WATCH WITH CALENDAR MECHANISM EQUIPPED WITH MONTH INDICATOR AND DATE INDICATOR

BACKGROUND OF THE INVENTION

1. Field of the Invention

The present invention relates to a watch with a calendar mechanism equipped with a month indicator and a date indicator. In particular, the present invention relates to a watch with a calendar mechanism which indicates month by a month indicator arranged on the inner side of the watch and which indicates date by a date indicator arranged on the outer side of the month indicator so that there is no need to correct the indication of the date indicator at the end of a month except for February.

2. Description of the Related Art

Generally speaking, a machine body inclusive of a driving portion of a watch is referred to as a "movement." A watch completed by mounting a dial and hands to a movement and putting the whole into a watch case is referred to as a "complete." Of both sides of a main plate forming the base plate of the watch, the side on which the glass of the watch case exists, that is, the side on which the dial exists, is referred to as the "back side" or the "glass side" or the "dial side" of the movement. Of both sides of the main plate, the side on which the case back of the watch case exists, that is, the side opposite to the dial, is referred to as the "front side" or the "case back side" of the movement. A train wheel assembled to the "front side" of the movement is referred to as the "front train wheel." A train wheel assembled to the "back side" of the movement is referred to the "back train wheel."

Generally speaking, in an analog watch, a "12 o'clock side" refers to the side of the dial where the mark corresponding to 12 o'clock is arranged. In an analog watch, a "12 o'clock direction" refers to the direction from the rotation center of the hand toward the "12 o'clock" side. In an analog watch, a "3 o'clock side" refers to the side of the dial where the mark corresponding to 3 o'clock is arranged. In an analog watch, a "3 o'clock direction" refers to the direction from the rotation center of the hand toward the "3 o'clock side." In an analog watch, a "6 o'clock side" refers to the side of the dial where the mark corresponding to 6 o'clock is arranged. In an analog watch, a "6 o'clock direction" refers to the direction from the rotation center of the hand toward the "6 o'clock side." In an analog watch, a "9 o'clock side" refers to the side of the dial where the mark corresponding to 9 o'clock is arranged. In an analog watch, a "9 o'clock direction" refers to the direction from the rotation center of the hand toward the "9 o'clock side." Further, in some cases, a side of the dial on which some other mark is arranged is referred to, as in the case of a "2 o'clock direction" and a "2 o'clock side."

In a first type of conventional watch with a calendar mechanism, a 1st date recess for detecting the first date of a date plate and a 30th date recess for detecting the 30th date of the date plate are formed at the same level in the inner periphery of the date plate with respect to the rotation axis direction of a date indicator driving wheel. A date feeding finger and a month feeding finger are provided on the date indicator driving wheel. A 1st day is detected by a 1st day detecting portion of a 1st day detecting lever, and a month feeding finger is controlled by a month feeding regulating portion of a month feeding control device, with no month feeding effected except for the 1st date. When the 1st date is attained, the month plate is fed by the month feeding finger. In the case of a longer month, a shorter month detecting lever regulates the date feeding finger such that the date plate is fed only one day by the date feeding finger. In the case of a shorter month, the shorter month detecting lever can rotate counterclockwise, making it possible to successively feed two teeth of the date plate by the date feeding finger. Only when a 30th date detecting lever is engaged with the 30th date recess to thereby detect the 30th date, and the shorter month detecting lever simultaneously detects a shorter month, are two teeth of the date plate fed by the date feeding finger (See, for example, Japanese Patent No. 2651150).

In a second type of conventional watch with a calendar mechanism, a tooth portion coming into contact with the date feeding finger, the 30th date recess for detecting the 30th date of the date plate, and the 1st date recess for detecting the 1st date of the date plate are formed stepwise at different levels in the inner periphery of the date plate with respect to the rotation axis direction of the date indicator driving wheel (See, for example, Patent Document JP-A-2005-195370).

In a third type of conventional watch with a calendar mechanism, a cutout is provided in a date indicating member, and, only when the date indicating member is at a specific position, is month indication effected by the cutout (See, for example, Patent Document JP-A-54-73667).

A fourth type of conventional watch with a calendar mechanism is equipped with a date driving wheel set, and a year indicator has 24 teeth, which is double the number of months in a year; an intermediate wheel has a first wheel in mesh with the year indicator and a second wheel fixed in position so as to be coaxial with the first wheel, with the second wheel being in mesh with a protrusion arranged on the inner side of a second stage of a date ring at the end of each month (See, for example, Patent Document JP-A-2006-162611).

In the first type of conventional watch with a calendar mechanism, the 1st date recess of the date plate and the 30th date recess of the date plate are formed at the same level, so that the 30th date detecting portion detects both recesses of the date plate, resulting in a rather unstable operation of the calendar mechanism. Further, in this structure, the three control levers, that is, the 1st date detecting lever, the shorter month detecting lever, and the 30th date detecting lever are arranged between the date plate and the month plate, so that the structure of the calendar mechanism is rather complicated, and it is rather difficult to reduce the size of the watch.

In the second type of conventional watch with a calendar mechanism, the 30th date recess of the date plate to be engaged with the 30th date detecting lever and the 1st date recess of the date plate to be engaged with the 1st date detecting lever are formed at different levels in the thickness direction of the movement, so that the thickness of the date plate increases, resulting in an increase in the thickness of the movement.

In the third type of conventional watch with a calendar mechanism, the month indication is effected through the cutout of the date indicating member, so that the month indication is rather small and hard to see. Further, in this structure, the month indication can only be seen on a specific day.

In the fourth type of conventional watch with a calendar mechanism, the structure of the date driving wheel set is rather complicated, and it is rather difficult to attain a reduction in the size and thickness of the watch. Further, in this structure, the month indication is rather small and hard to see.

SUMMARY OF THE INVENTION

It is an aspect of the present invention to provide a watch with a calendar mechanism in which the date feeding mechanism and the month feeding mechanism are formed thin and small, making it possible to form the movement in a small thickness.

It is another aspect of the present invention to provide a watch with a calendar mechanism in which the structure of the date feeding mechanism and the month feeding mechanism is simple and which is stable in its operation.

It is another aspect of the present invention to provide a watch with an automatic calendar mechanism in which the month indication is large and easy to see and in which there is no need to correct the indication of the date indicator at the end of each month except for February.

According to the present invention, there is provided a watch with a calendar mechanism equipped with a month indicator and a date indicator, the watch comprising:

a date indicator indicating date;

a month indicator rotating based on rotation of the date indicator to indicate month;

a date indicator driving wheel formed so as to make one rotation per 24 hours;

a date feeding finger formed to be capable of causing the date indicator to rotate based on the rotation of the date indicator driving wheel; and a shorter month end feeding lever formed so as to be capable of rotating the date indicator based on the rotation of the date indicator driving wheel and the rotation of the month indicator, characterized in that the date indicator includes a date indicating surface portion provided with a date letter, a date indicator tooth portion coming into contact with a date feeding portion of the date feeding finger, and a month end tooth for feeding the date indicator at the end of each month, the month indicator includes a month indicating surface portion provided with a month letter, and a month cam for operating a shorter month end feeding lever at the end of a shorter month, the month end tooth of the date indicator is arranged so as to be capable of coming into contact with the shorter month end feeding lever when the date letter indicates a month end, and the shorter month end feeding lever is formed so as to be capable of feeding the date indicator by one day based on the rotation of the date indicator driving wheel and the month cam at the end of a shorter month, the watch further comprising a month feeding lever formed so as to be capable of moving based on the rotation of the date indicator to rotate the month indicator, with the month feeding lever being formed so as to be capable of feeding the month indicator at the end of a month.

Due to this construction, it is possible to realize a watch with a calendar mechanism whose movement has a small thickness. Due to this construction, it is possible to realize a watch with a calendar mechanism in which the operation of the date feeding mechanism and the month feeding mechanism is stable. Further, due to this construction, no excessive load is applied to the transmission train wheel at the time of usual date feeding.

In the watch with a calendar mechanism of the present invention, it is desirable that the month feeding lever be formed so as to move toward the month indicator based on the rotation of the date indicator and to be restored to its former position by the resilient force of a spring portion of the month feeding lever. Due to this construction, it is possible to realize a watch with a calendar mechanism in which the operation of the date feeding mechanism and the month feeding mechanism is stable.

In the watch with a calendar mechanism of the present invention, it is desirable that the shorter month end feeding lever include a month end feeding finger for feeding the date indicator at the end of a shorter month, the month end tooth being provided for the purpose of detecting a time when the date indicator indicates a "30th day", the month end tooth being provided on an inner side wall portion of the date indicator, the month end tooth of the date indicator being arranged so as to be capable of coming into contact with the shorter month end feeding finger when the date letter indicates the end of a month. Due to this construction, it is possible to realize a watch with a calendar mechanism in which the operation of the date feeding mechanism and the month feeding mechanism is stable.

In the watch with a calendar mechanism of the present invention, it is desirable that the shorter month end feeding lever be arranged on the upper side of the date feeding finger, and be formed so as to be movable with respect to the rotation center of the date indicator driving wheel. Due to this construction, it is possible to realize a watch with a calendar mechanism whose movement has a small thickness.

In the watch with a calendar mechanism of the present invention, it is desirable that the month end tooth be arranged on the inner side of the date indicating surface portion on the side nearer to the date indicator tooth portion than to the date indicating surface portion. Due to this construction, it is possible to realize a watch with a calendar mechanism whose movement has a small thickness.

In the watch with a calendar mechanism of the present invention, it is desirable that the date indicator driving wheel have a lever driving pin, the shorter month end feeding lever being rotated by the lever driving pin and movable with respect to the month end tooth based on the rotation of the month indicator. In the watch with a calendar mechanism of the present invention, it is desirable that the shorter month end feeding lever be formed as a single plate. In the watch with a calendar mechanism of the present invention, it is desirable that the month end tooth be provided solely at one position of the date indicator, and be formed so as to be capable of a date feeding operation at the end of a shorter month and an operation of feeding the month indicator by the month end tooth. Due to this construction, it is possible to realize a watch with a calendar mechanism in which the operation of the date feeding mechanism and the month feeding mechanism is stable.

Next, the operation in a typical indication state in the watch with a calendar mechanism of the present invention will be described. In the watch with a calendar mechanism of the present invention, in the state in which the "30th day" of a "longer month" is displayed, the month display is "OCT," which corresponds to "October." When the date indicator driving wheel rotates, the date feeding portion of the date feeding finger comes into contact with one tooth of the date indicator, and the shorter month end feeding cam of the shorter month end feeding lever does not come into contact with the month cam of a month star. When the date indicator driving wheel further rotates, the date feeding finger further rotates, and the date indicator is fed by one tooth in a fixed direction. The date feeding finger feeds the date indicator by one tooth in a fixed direction, and the date indication is turned to the "31st day." The month feeding tooth of the date indicator does not come into contact with the finger portion of the month feeding lever, or the month feeding tooth of the date indicator comes into contact with the finger portion of the month feeding lever; however, the month feeding portion of the month feeding lever does not come into contact with a month star tooth portion of the month star, so that, when transition is effected from the state in which the "30th day" of a "longer month" is displayed to the state in which the "31st day" is displayed, no month feeding is effected; thus, the month display is not changed but remains "OCT." The operation in a "longer month" other than "October" is the same as that for "October."

In the watch with a calendar mechanism of the present invention, in the state in which the "30th day" of a "shorter month" is displayed, the month display is "NOV," which corresponds to "November"; in this state, a "shorter month" is detected based on the rotation of the date indicator, and, at the same time, the "30th day" is detected. The smaller month end feeding finger of the smaller month end feeding lever feeds the month end tooth of the date indicator, and the month end tooth of the date indicator rotates so as to approach the month feeding lever. Further, when the date indicator driving wheel 210 rotates, the date display is changed to the "31st day." When the date indicator driving wheel further rotates, the date feeding finger further rotates, and it is possible to feed only one tooth of the date indicator in a fixed direction. The month end tooth of the date indicator causes the month feeding lever to move toward the month star. Due to the movement of the month feeding lever toward the month star, it is possible to feed the month star tooth portion of the month star by only one tooth in a fixed direction. Thus, the date display is changed to the "1st day," and the month display is changed to "DEC." The operation at the end of a "shorter month" other than "November" is the same as the operation at the end of "November."

As described above, in the watch with a calendar mechanism of the present invention, in a smaller month, date feeding is effected at the end of the month by the operation of the month end tooth provided on the date indicator, and the month feeding lever is moved toward the month star through the operation of the month end tooth provided on the date indicator, making it possible to effect month feeding. Thus, due to this construction, in the present invention, it is possible to realize a watch with a calendar mechanism whose movement has a small thickness; further, it is possible to realize a watch with a calendar mechanism constructed such that no excessive load is applied to the transmission train wheel at the time of usual date feeding.

In the watch with a calendar mechanism of the present invention, the date feeding mechanism and the month feeding mechanism are thin and small. Further, in the watch with a calendar mechanism of the present invention, the structure of the date feeding mechanism and the month feeding mechanism is simple, and the operation thereof is stable. Further, the watch with a calendar mechanism of the present invention can be constructed such that no excessive load is applied to the transmission train wheel at the time of usual date feeding. Further, in the watch with a calendar mechanism of the present invention, the month display is large and easy to see, and there is no need to correct the indication of the date indicator at the end of a month except for February.

DESCRIPTION OF THE PREFERRED EMBODIMENTS

Figure 1:
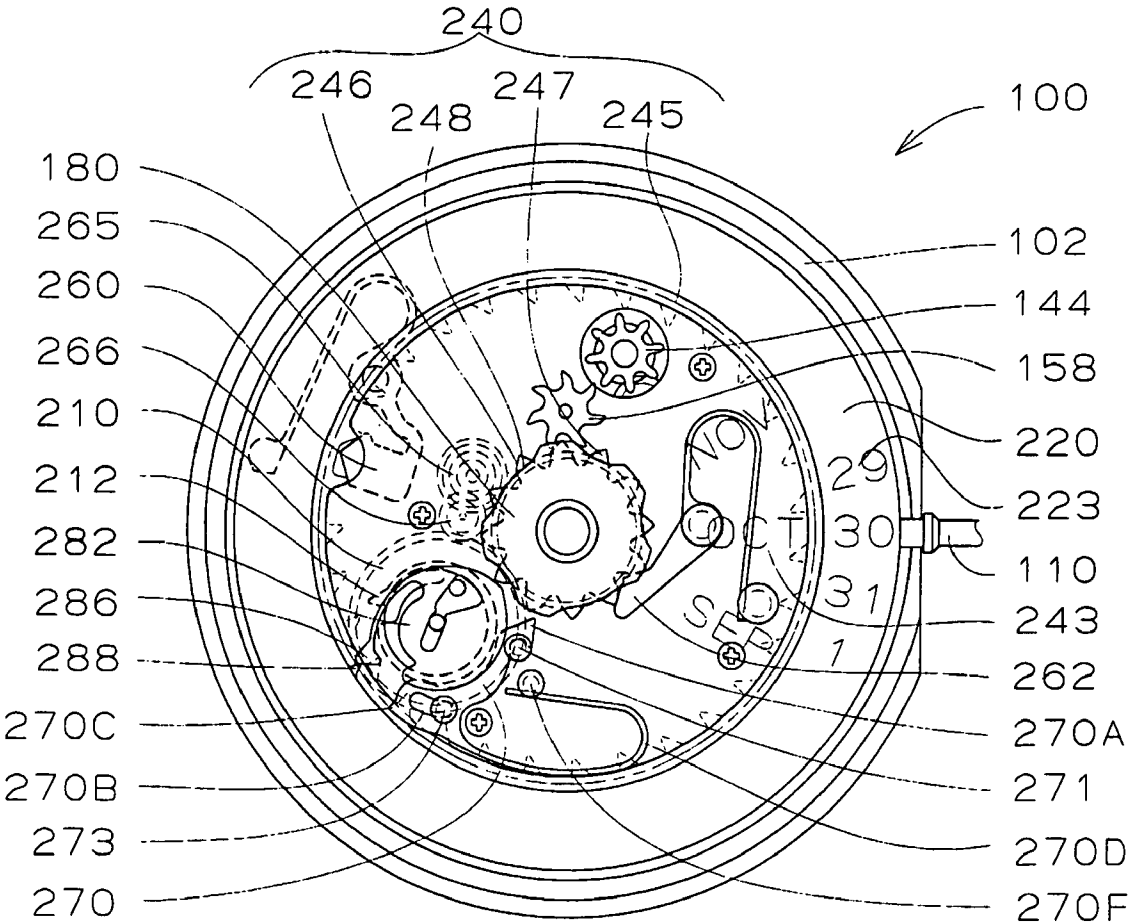
FIG. 1 is a schematic plan view of the structure of a movement as seen from the dial side in an embodiment of the watch with a calendar mechanism of the present invention.

In the following, an embodiment of the watch with a calendar mechanism of the present invention will be described with reference to the drawings. In the embodiment of the present invention described below, the watch with a calendar mechanism is formed as a mechanical watch. While in the example described below the watch with a calendar mechanism of the present invention is applied to a mechanical watch, the present invention is applicable not only to a mechanical watch but also to an analog electronic watch. That is, in this specification, the concept of "a watch with a calendar mechanism" covers a "mechanical watch," an "analog electronic watch," and analog watches of all the other operating principles.

(1) General Construction of the Movement

Referring to FIGS. 1 through 4 and FIG. 27, a movement 100 is formed by a mechanical watch. The movement 100 includes a main plate 102 constituting the substrate of the movement 100. A dial 104 is mounted to the glass side of the movement 100. A winding stem 110 is rotatably incorporated into the main plate 102. A switching device includes the winding stem 110, a setting lever 120, a yoke 122, and a yoke holder 124. A setting device includes a balance train wheel setting lever 170 and a balance setting pin 170A. It is desirable for the balance setting pin 170A to be fixed to the balance train wheel setting lever 170.

(2) Construction of the Front Side of the Movement

Next, the construction of the front side of the movement will be described. Referring to FIGS. 2 through 4 and FIG. 27, the movement (the machine body) 100 has the main plate 102 constituting the substrate of the movement. The winding stem 110 is arranged in the "3 o'clock direction" of the movement. The winding stem 110 is rotatably incorporated into the winding stem guide hole of the main plate 102. The dial 104 is mounted to the movement 100. An escapement/governor device including a balance with hairspring 340, an escape wheel & pinion 330, and a pallet fork 342, and a front train wheel including a second wheel & pinion 442, a third wheel & pinion 326, a center wheel & pinion 325, and a movement barrel 320, are arranged on the "front side" of the movement 100. The switching device including the setting lever, the yoke, and the yoke holder is arranged on the "back side" of the movement. Further, a barrel bridge (not shown) rotatably supporting an upper shaft portion of the movement barrel 320, a train wheel bridge (not shown) rotatably supporting an upper shaft portion of the third wheel & pinion, an upper shaft portion of the second wheel & pinion 442, and an upper shaft portion of the escape wheel & pinion 330, a pallet bridge (not shown) rotatably supporting an upper shaft portion of the pallet fork 342, and a balance bridge (not shown) rotatably supporting the upper shaft portion of the balance with hairspring 340, are arranged on the "front side" of the movement 100.

A crown wheel (not shown) is formed so as to be rotatable through rotation of a winding pinion 116. A crown transmission wheel (not shown) is formed so as to be rotatable through rotation of the crown wheel. A ratchet sliding wheel (not shown) is formed so as to be rotatable through rotation of the crown transmission wheel. A ratchet wheel (not shown) rotates through rotation of the ratchet sliding wheel. The movement barrel 320 is equipped with a barrel wheel, a barrel arbor, and a mainspring. Through rotation of the ratchet wheel, the main spring accommodated in the movement barrel 320 is wound up.

The center wheel & pinion 325 is formed so as to rotate through rotation of the movement barrel 320. The center wheel & pinion 325 includes a center wheel and a center pinion. A barrel wheel is formed so as to be in mesh with the center pinion. The third wheel & pinion 326 is formed so as to be rotatable through rotation of the center wheel & pinion 325. The third wheel & pinion 326 includes a third wheel and a third pinion. The second wheel & pinion 442 is formed so as to make one rotation per minute through rotation of the third wheel & pinion 326. The second wheel & pinion 442 includes a second wheel and a second pinion. The third wheel is formed so as to be in mesh with the second pinion. Through rotation of the second wheel & pinion 442, the escape wheel & pinion 330 rotates while controlled by the pallet fork 342. The escape wheel & pinion 330 includes an escape wheel and an escape pinion. The second wheel is formed so as to be in mesh with the escape pinion. A minute indicator 446 is formed so as to rotate through rotation of the movement barrel 320. The movement barrel 320, the center wheel & pinion 325, the third wheel & pinion 326, the second wheel & pinion 442, and the minute indicator 446 constitute the front train wheel. The escapement/governor device for controlling the rotation of the front train wheel includes the balance with hairspring 340, the escape wheel & pinion 330, and the pallet fork 342. The escape wheel & pinion 330, the pallet fork 342, and the balance with hairspring 340 constitute the escapement/governor device. The balance with hairspring 340 includes a balance staff, a balance wheel, and a hairspring. The hairspring is a thin plate spring in the form of a spiral spring with a plurality of number of turns. The balance with hairspring 340 is supported so as to be rotatable with respect to the main plate 102 and the balance bridge.

Rotatable supporting is effected with respect to movement barrel 320, the main plate 102, and the barrel bridge. The center wheel & pinion 325 is supported so as to be rotatable with respect to the main plate 102 and a center wheel bridge (not shown). A lower shaft portion of the third wheel & pinion 326 and a lower shaft portion of the escape wheel & pinion 330 are supported so as to be rotatable with respect to the main plate 102. The upper shaft portion of the third wheel & pinion 326, the upper shaft portion of the second wheel & pinion 442, and the upper shaft portion of the escape wheel & pinion 330 are supported so as to be rotatable with respect to the train wheel (not shown). The minute indicator 446 is rotatably supported by the outer peripheral portion of a central pipe 103 fixed to a center wheel bridge (not shown). The lower shaft portion of the second wheel & pinion 442 is rotatably supported in the center hole of the central pipe 103 fixed to the center wheel bridge (not shown). The pallet fork 342 is supported so as to be rotatable with respect to the main plate 102 and the pallet bridge 364. The upper shaft portion of the pallet fork 342 is supported so as to be rotatable with respect to the pallet bridge 364. The lower shaft portion of the pallet fork 342 is supported so as to be rotatable with respect to the main plate 102.

A minute wheel 166 rotates based on the rotation of the minute indicator 446. An hour wheel 180 rotates based on the rotation of the minute wheel 166. When the center wheel & pinion 325 rotates, the second wheel & pinion 442 makes one rotation per minute through rotation of the third wheel & pinion 326. The hour wheel 180 makes one rotation per hour. The minute indicator 446 is provided with a slip mechanism.

(3) Construction of the Switching Device

Next, the construction of the front side of the movement will be described. Referring to FIGS. 1 through 4, the winding stem 110 has a corner portion and a guide shaft portion. A square hole of a clutch wheel 114 is incorporated into the corner portion of the winding stem 110. The clutch wheel 114 has a rotation axis which is the same as that of the winding stem 110. Through fit-engagement of the square hole of the clutch wheel 114 and the corner portion of the winding stem 110, the clutch wheel 114 rotates based on the rotation of the winding stem 110. The clutch wheel 114 has a tooth A 114A and a tooth B 114B. The tooth A 114A is provided at the end portion of the clutch wheel 114 nearer to the center of the movement. The tooth B 114B is provided at the end portion farther from the center of the movement.

A winding pinion 116 is rotatably provided on the guide shaft portion of the winding stem 110. The winding pinion 116 has an inner tooth 116A and an outer tooth 116B. In the state in which the winding stem 110 is at a first winding stem position (0th step) nearest to the inner side of the movement along the rotation axis direction, the tooth B 114*b* of the clutch wheel 114 is engaged with the inner tooth 116A of the winding pinion 116. When, in this state, the winding stem 110 is rotated, the winding pinion 116 rotates through the rotation of the clutch wheel 114. In the state in which the winding stem 110 is at the "1st step" and the "2nd step", the tooth B of the clutch wheel 114 is not in mesh with the inner tooth 116A of the winding pinion 116.

A setting lever 120 is rotatably arranged on the back side of the main plate 102. A yoke 122 is rotatably arranged on the back side of the main plate 102. The yoke 122 is urged by the resilient force of a yoke spring portion 122A so as to be pressed against the distal end portion of the setting lever 120. A yoke holder 124 is provided so as to hold the setting lever 120 and the yoke 122. A setting lever positioning pin provided on the setting lever 120 is engaged with a setting lever positioning chevron-shaped portion of the yoke holder 124, and positioning is effected on the setting lever 120 at three rotational positions by the yoke holder 124.

The winding stem guide portion of the setting lever 120 is engaged with a step portion 110*c* of the winding stem 110, and positioning is effected in the rotation axis direction of the winding stem 110 based on the rotation of the setting lever 120. The clutch wheel guide portion of the yoke 122 is engaged with the step portion of the clutch wheel 114, and positioning is effected in the rotation axis direction of the clutch wheel 114 based on the rotation of the yoke 122. Positioning is effected on the yoke 122 at two positions in the rotating direction based on the rotation of the setting lever 120.

In the state in which the winding stem 110 is at the "0th step," the clutch wheel 114 is at a first position near the outer side of the movement, and, in the state in which the winding stem 110 is at the "1st step" and the "second step," the clutch wheel 114 is at a second position near the inner side of the movement.

The setting lever 120, the yoke 122, and the yoke holder 124 constitute the switching device of the watch. The setting lever 120, and the setting lever positioning chevron-shaped portion of the yoke holder 124 constitute a winding stem positioning means for effecting positioning on the winding stem 110 in the rotation axis direction. The yoke 122 constitutes a clutch wheel positioning means operating based on the operation of the setting lever 120 and the yoke holder 124.

A setting wheel pin 102C constituting the rotation center of a setting wheel 128 is provided on the back side of the main plate 102 and in the rotation axis of the winding stem 110. The setting wheel 128 is rotatably assembled to the setting wheel pin 102C. In the state in which the winding stem 110 is at the "0th step," the setting wheel 128 is out of mesh with the tooth A 114A of the clutch wheel 114, and in the state in which the winding stem 110 is at the "1st step" and the "2nd step,", it is in mesh with the tooth A 114A of the clutch wheel 114.

(4) Construction of the Correction Device

A rocking bar 130 is provided so as to be rockable around the setting wheel pin 102C. A rocking bar stopping frame 136 is fitted onto the top portion of the setting wheel pin 102C. The rocking bar stopping frame (not shown) is provided for the purpose of rockably retaining the rocking bar 130. The rocking bar stopping frame may be fixed to the top portion of the setting wheel pin 102C, or the rocking bar stopping frame may be arranged at the top portion of the setting wheel pin 102C.

The rocking bar 130 includes a rocking bar first portion 130A arranged on one side of the setting wheel pin 102C, that is, on the 1 o'clock side of a reference axis 112, and a rocking bar second portion 130B arranged on the other side of the setting wheel pin 102C, that is, on the 5 o'clock side of the reference axis 112. The rocking bar 130 has a setting lever engagement portion 130E. It is desirable for the setting lever engagement portion 130E of the rocking bar 130 to be formed as a spring portion capable of elastic deformation.

A first correction transmission wheel 132 is rotatably mounted to the rocking bar first portion 130A. A second correction transmission wheel 134 is rotatably mounted to the rocking bar first portion 130A. The first correction transmission wheel 132 is in mesh with the setting wheel 128 and a second correction transmission wheel 134. The first correction transmission wheel 132 has a first correction transmission wheel shaft portion (not shown).

A second correction transmission wheel 134 has a second correction transmission wheel shaft portion (not shown). A rocking bar positioning hole (not shown) is provided in the main plate 102. The second correction transmission wheel shaft portion is arranged in the rocking bar positioning hole. The position of the rocking bar 130 in the rotating direction is determined through the second correction transmission wheel shaft portion coming into contact with the cylindrical wall surface of the rocking bar positioning hole. Thus, when the winding stem 110 is at the second winding stem position (1st step), the first correction transmission wheel 132 and the second correction transmission wheel 134 constitute a first correction train wheel which is provided on the rocking bar 130 and which serves to correct the indication of the date indicator 220 and the month indicator 240 based on the rotation of the setting wheel 128.

While it is desirable for the number of correction transmission wheels constituting the first correction train wheel to be two, it may also be one or three or more. A third correction transmission wheel 140 is rotatably provided on the main plate 102. A rocking lever 142 is provided so as to be rockable with respect to the third correction transmission wheel. The rocking lever 142 is mounted to the third correction transmission wheel 140 such that the third correction transmission wheel 140 can slip with respect to the rocking lever 142 when a fixed slip torque is exceeded. In an embodiment of the present invention, it is desirable for this slip torque to range from 1 g·cm to 2 g·cm.

A correction wheel 144 is rotatably provided on the rocking lever 142. The correction wheel 144 has a correction pinion (not shown), a correction gear (not shown), and a correction wheel shaft portion (not shown). The third correction transmission wheel 140 is in mesh with the second correction transmission wheel 134 and the correction pinion. A rocking lever positioning hole (not shown) is provided in the main plate 102. The correction wheel shaft portion is arranged in the rocking lever positioning hole. The position of the rocking lever 142 in the rotating direction is determined through the correction wheel shaft portion coming into contact with the cylindrical wall surface of the rocking lever positioning hole.

A date indicator 220 constituting a date indicating member for indicating date is rotatably incorporated into the main plate 102. The date indicator 220 has 31 date indicator teeth, and is rotated by a date feeding mechanism (described below). The position of the date indicator 220 in the rotating direction is determined by a date jumper 260. A date indicator maintaining plate 264 retains the date indicator 220.

There is provided a month indicator 240 constituting a month indicating member for indicating month. The month indicator 240 has a month star 247 having 12 teeth, and the month star 240 is rotated by a month feeding mechanism (described below). The position of the month indicator 240 in the rotating direction is determined by a month jumper 262. A month corrector setting wheel 158 is rotatably incorporated. The month corrector setting wheel 158 is in mesh with the month star 247.

A first intermediate minute wheel 160 is rotatably mounted to a rocking bar second portion 130B. A second intermediate minute wheel 162 is rotatably mounted to the rocking bar second portion 130B. The first intermediate minute wheel 160 is in mesh with the setting wheel 128 and the second intermediate minute wheel 162. A minute wheel 166 is arranged in a "second region."

The first intermediate minute wheel 160 and the second intermediate minute wheel 162 constitute a second correction train wheel which is provided on the rocking bar 130 and which serves to rotate the minute wheel 166 based on the rotation of the setting wheel 128 to correct the indication of the time indicating member when the winding stem 110 is at a third winding stem position (2nd step). While it is desirable for the number of intermediate minute wheels constituting the second correction train wheel to be two, it may also be one or three or more.

(5) Construction of the Setting Device

A balance train wheel setting lever 170 that operates based on the operation of the switching device to set the operation of the time indicating member is provided so as to be rotatable around the rotation center of the yoke 122. When the winding stem 110 is at the 0th step and 1st step, the balance train wheel setting lever 170 is rotated clockwise by the setting lever 120, and a rocking bar contact portion (not shown) of the balance train wheel setting lever 170 abuts the first correction transmission shaft portion to effect positioning.

The balance train wheel setting lever 170 pushes the first correction transmission shaft portion, whereby the rocking bar 130 is rotated clockwise. As described above, the position of the rocking bar 130 in the rotating direction is determined when the rocking bar 130 rotates clockwise and the second correction transmission shaft portion abuts the cylindrical wall surface of the rocking bar positioning hole. When the winding stem 110 is at the 0th step and 1st step, the balance setting pin 170A of the train wheel setting lever 170 does not come into contact with a balance with hairspring 340. When the winding stem 110 is at the third winding stem position (2nd step), the balance setting pin 170A of the train wheel setting lever 170 comes into contact with the balance with hairspring 340.

(6) Construction of the Calendar Mechanism

Next, the construction of the calendar mechanism will be described. FIG. 1 is a plan view showing the construction of the back side of the movement 100 as seen from the dial side in the state in which October 30 is displayed. Referring to FIGS. 1 through 5, the movement 100 is equipped with a first intermediate date wheel 265 adapted to rotate through rotation of the hour wheel 180, a second intermediate date wheel 266 adapted to rotate through rotation of the first intermediate date wheel 265, a date indicator driving wheel 210 adapted to rotate through rotation of the second intermediate date wheel 266, the date indicator 220 indicating date, a date jumper 260 for setting the position of the date indicator 220 in the rotating direction, the month indicator 240 indicating month, a month jumper 262 for setting the position of the month indicator 240 in the rotating direction, and a date indicator maintaining plate 264 supporting the date indicator 220 so as to allow it to rotate counterclockwise with respect to the main plate 102. The date indicator driving wheel 210 is constructed so as to make one counterclockwise rotation per 24 hours. The date indicator driving wheel 210 has a lever driving pin 211.

It is desirable for the rotation center of the date indicator driving wheel 210 to be arranged in the movement 100 between the "6 o'clock direction" and the "9 o'clock direction." More preferably, the rotation center of the date indicator driving wheel 210 is arranged in the movement 100 between the "7 o'clock direction" and the "8 o'clock direction." The date indicator driving wheel 210 is preferably arranged so as not to overlap the movement barrel 320. It is desirable for the rotation center of the date indicator 220 to be at the same position as the rotation center of the hour wheel 180.

The date indicator 220 includes an inner side wall portion 221 facing the inner side of the movement, a date plate portion 225 including a date indicating surface portion 224 provided with date letters 223, and a date indicator tooth portion 226. The date indicator tooth portion 226 includes 31 inner teeth arranged at equal angular intervals (360/31 degrees). The date letters 223 may consist of numbers indicating 31 "dates" arranged at equal angular intervals (360/31 degrees) (e.g., "1," "2," "3," . . . "29," "30," and "31").

The inner side wall portion 221 of the date indicator 220 is arranged on the inner side of the date indicating surface portion 224. The date indicator tooth portion 226 is arranged on the down surface side of the date indicator 220. On the inner side wall portion 221 of the date indicator 220, there is provided a month end tooth 288 for enabling the operation of feeding the date indicator 220 when the date indicator 220 indicates "30th day" in a shorter month and the operation of feeding the month indicator 240 when the date indicator 220 indicates "31st day." The month end tooth 288 is formed on the inner side wall portion 221 of the date indicator 220 as an only one protrusion protruding radially inwards.

The month indicator 240 includes a month plate 245 inclusive of a month indicating surface portion 244 provided with month letters 243, a month star 247 inclusive of a month star tooth portion 246, and month cams 248 corresponding to times when the indication of the month indicator 240 is a "longer month" (i.e., "January" or "JAN" or the like, "March" or "MAR" or the like, "May" or "MAY" or the like, "July" or "JUL" or the like, "August" or "AUG" or the like, "October" or "OCT" or the like, "December" or "DEC" or the like). The month cams 248 are formed as recesses recessed radially inwards at seven positions as a January cam 248A corresponding to January, a March cam 248B corresponding to March, a May cam 248C corresponding to May, a July cam 248D corresponding to July, an August cam 248E corresponding to August, an October cam 248F corresponding to October, and a December cam 248G corresponding to December. Using the January cam 248A as a reference position, the month cams 248 are arranged counterclockwise sequentially at the following angular intervals: (2*360/12 degrees), (2*360/12 degrees), (2*360/12 degrees), (1*360/12 degrees), (2*360/12 degrees), (2*360/12 degrees), and (1*360/12 degrees) (See FIG. 5).

The month star tooth portion 246 includes 12 outer teeth arranged at equal angular intervals (360/12 degrees). The month letters 243 may consist of twelve letters indicating "months" arranged at equal angular intervals (360/12 degrees) (e.g., "JAN," "FEB," . . . , "NOV," "DEC," etc.). Alternatively, the month letters 243 may consist of twelve numbers, symbols, letters, abbreviations, or appropriate combinations thereof indicating "months" (e.g., "January," "February," . . . "November," and "December," or "Jan," "Feb," . . . "Nov," "Dec," etc.).

Shorter month detecting cams 249 are provided for the purpose of detecting times when the month indicator 240 indicates a "shorter month" (that is, "February," "April," "June," "September," and "November"). The shorter month detecting cams 249 are provided at five positions as protrusions protruding radially outwards. The distal end portions of the protrusions are preferably formed as a part of arcs of the same radius. The shorter month detecting cams 249 include five recesses: a February cam 249A corresponding to February, an April cam 249B corresponding to April, a June cam 249C corresponding to June, a September cam 249D corresponding to September, and a November cam 249E corresponding to November. Using the February cam 249A as a reference, the shorter month detecting cams 249 are arranged sequentially clockwise at the following angular intervals: (2*360/12 degrees), (2*360/12 degrees), (3*360/12 degrees), (2*360/12 degrees), and (3*360/12 degrees).

The setting portion of the date jumper 260 is constructed so as to set the date indicator tooth portion 226. The setting portion of the month jumper 262 is constructed so as to set the month star tooth portion 246. It is desirable for the rotation center of the month indicator 240 to be at the same position as the rotation center of the hour wheel 180. Thus, the rotation center of the month indicator 240 is preferably at the same position as the rotation center of the date indicator 220. The month indicating surface portion 244 of the month indicator 240 is arranged on the inner side of the date indicating surface portion 224 of the date indicator 220.

A date feeding finger 212 for feeding the date indicator tooth portion 226 of the date indicator 220 is provided so as to rotate integrally with the rotation of the date indicator driving wheel 210. The date feeding finger 212 includes a date feeding portion 213 arranged at the distal end and a date feeding finger spring portion 214. The proximal portion of the date feeding finger spring portion 214 is fixed to the date indicator driving wheel 210. Through rotation of the date indicator driving wheel 210, the date feeding finger 212 rotates, and the date indicator 220 can be rotated by the date feeding finger 212 intermittently counterclockwise once in 24 hours by 360/31 degrees.

The date feeding finger 212 is formed of a material capable of elastic deformation (e.g., an engineering plastic such as polyacetal). The date feeding finger can be formed so as to be integral with the date indicator driving wheel 210. The date feeding finger 212 is formed separately from the date indicator driving wheel 210, and can rotate integrally through rotation of the date indicator driving wheel 210.

A month feeding lever 270 is operably arranged between the month plate 245 and the date indicator maintaining plate 264. The month feeding lever 270 is arranged so as to face the upper surface of the date indicator maintaining plate 264. Two month feeding lever guide pins 271 and 273 are provided on the date indicator maintaining plate 264 so as to operably guide and retain the month feeding lever 270. While it is desirable to provide two month feeding lever guide pins as shown in the drawings, the number of month feeding lever guide pins may also be three or more. A disc-like retaining portion of the month feeding lever guide pins 271 and 273 retain the month feeding lever 270 so as to face the date indicator maintaining plate 264.

The month feeding lever 270 includes a month feeding portion 270A arranged so as to be capable of coming into contact with the month wheel 246 of the month indicator 240, an operation guide portion 270B arranged so as to be capable of coming into contact with the month feeding lever guide pin 273, a month feeding operating portion 270C arranged so as to be capable of coming into contact with the month end tooth 288 of the date indicator 220, and a month feeding lever spring portion 270D. The portion of the month feeding lever spring portion 270D near the distal end portion thereof is formed so as to come into contact with a month feeding lever spring pin 270F provided on the date indicator maintaining plate 264. The rotation center of the date indicator driving wheel 210 is formed by a date indicator driving wheel pin 102P provided on the main plate 102.

A shorter month end feeding lever 282 is operably arranged between the month plate 245 and the date feeding finger 212. The shorter month end feeding lever 282 includes a shorter month end feeding cam 284 arranged so as to be capable of coming into contact with the shorter month detecting cam 249, a sector-shaped hole portion 282B arranged so as to be capable of coming into contact with the lever driving pin 211, a shorter month end feeding finger 286 arranged so as to be capable of coming into contact with the month end tooth 288 of the date indicator 220, and a lever elongated hole 282C. Positioning is effected on the shorter month end feeding lever 282 based on the rotation of the date indicator driving wheel 210 and the rotation of the month indicator 240, making it possible to rotate the date indicator 220 at the end of a shorter month. The shorter month end feeding lever 282 is arranged on the upper side of the date feeding finger 212, and can move with respect to the rotation center of the date indicator driving wheel 210.

The lever driving pin 211 is arranged in the sector-shaped hole portion 282B of the shorter month end feeding lever 282. The shorter month end feeding lever 282 is rotated by the lever driving pin 211. The lever elongated hole 282C of the shorter month end feeding lever 282 is arranged so as to face the date indicator driving wheel pin 102P. The shorter month end feeding lever 282 with the lever elongated hole 282C being guided by the date indicator driving wheel pin 102P, the shorter month end feeding lever 282 can move with respect to the month end tooth 288 radially outwards away from the center of the main plate 102 along the month cam 248 provided on the month indicator 240 and based on the rotation of the date indicator driving wheel 210. Due to this construction, it is possible to realize a watch with a calendar mechanism in which the operations of the date feeding mechanism and of the month feeding mechanism are stable. Further, due to this construction, it is possible to prevent an excessive load from being applied to the transmission train wheel at the time of usual date feeding.

When the date indicator 220 is rotated such that the indication of the date indicator 220 is changed from "31st day" to "1st day,", the month end tooth 288 of the date indicator 220 comes into contact with the month feeding operation portion 270C of the month feeding lever 270, making it possible to move the month feeding lever 270 toward the month indicator 240. Through the movement of the month feeding lever 270, the month feeding portion 270A rotates the month star tooth portion 246 and the month indicator 240, making it possible to change the indication of the month indicator 240.

(7) Operation of the Watch with a Calendar Mechanism

(7.1) Display of Time Information

Figure 25:
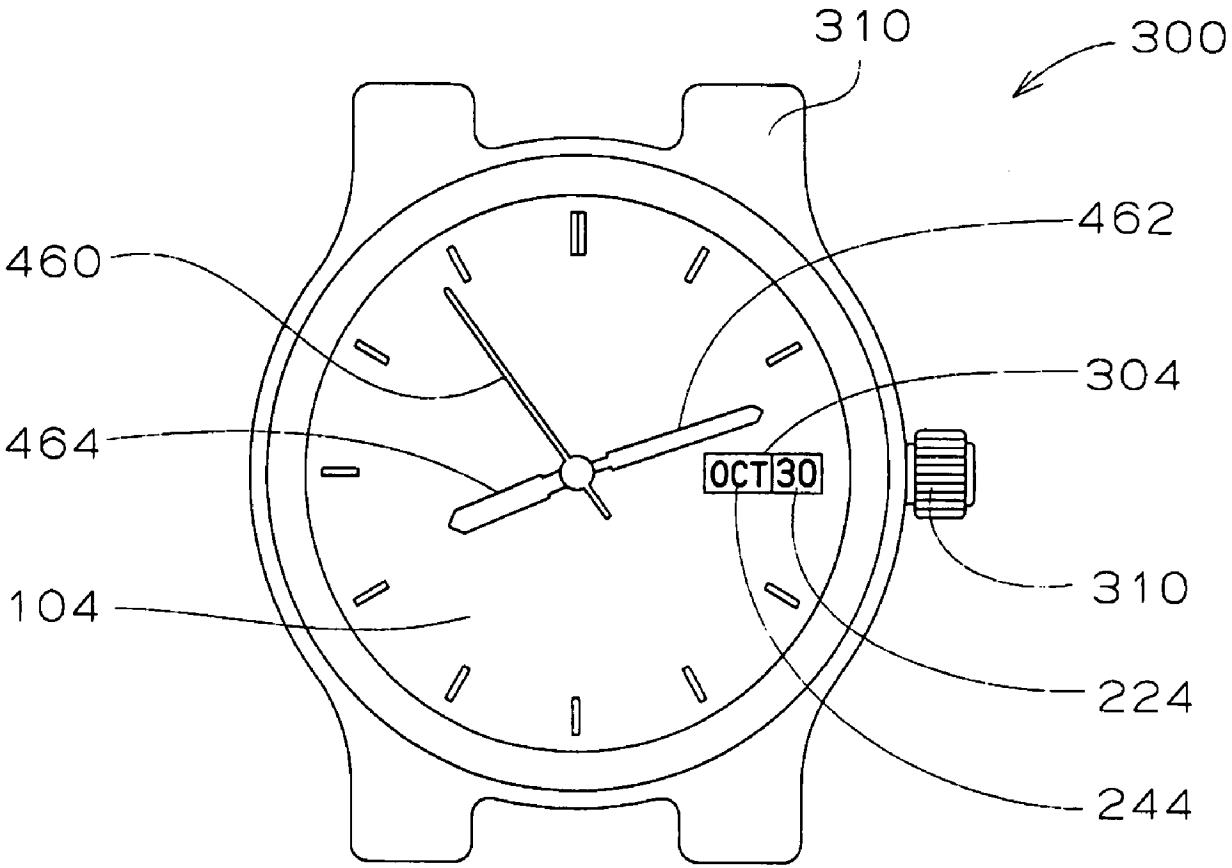
FIG. 25 is a plan view of a complete as indicating October 30, with a date window being arranged in the 3 o'clock direction of a dial, in an embodiment of the watch with a calendar mechanism of the present invention.

Next, the operation of the watch with a calendar mechanism of the present invention will be described. Referring to FIG. 25, the movement 100 is incorporated into a watch case 310, and the dial 104, a crown 310, an hour hand 464, a minute hand 462, and a second hand 460 are mounted to form a complete 300. Through a window 304 provided in the dial 104, it is possible to read the number "30" provided on the date indicating surface portion 224 and indicating date, and the letters "OCT" provided on the month indicating surface portion 244 and indicating month. That is, the complete 300 indicates "October 30." While FIG. 19B shows an embodiment of the watch with a calendar mechanism in which the window 304 is formed in the "3 o'clock" direction of the dial 104, it is also possible to realize a watch with a calendar mechanism in which the window is formed at a position of the dial 104 other than the "3 o'clock direction" through appropriate selection of the arrangement and orientation of the date letters and month letters.

Referring to FIGS. 1 through 4 and FIGS. 26 and 27, the mainspring (not shown) incorporated into the movement barrel 320 constitutes the power source of the watch. Through re-winding (releasing) of the mainspring, the barrel wheel of the movement barrel 320 rotates in one direction, and time information is displayed by the hands (the hour hand, the minute hand, the secondhand, etc.) through rotation of the front train wheel and the back train wheel. The rotation of the barrel wheel, which is rotated by the power of the mainspring, is controlled by the governor device and the escapement device. The governor device includes the balance with hairspring 340. The escapement device includes the pallet fork 342 and the escape wheel & pinion 330. Through rotation of the barrel wheel, the center wheel & pinion 325 rotates. Through the rotation of the center wheel & pinion 325, the third wheel & pinion 326 rotates. Through the rotation of the third wheel & pinion 326, the second wheel & pinion 442 makes one rotation per minute.

The rotation speed of the second wheel & pinion 442 is controlled by the escape wheel & pinion 330. The rotation speed of the escape wheel & pinion 330 is controlled by the pallet fork 342. The rocking motion of the pallet fork 342 is controlled by the balance with hairspring 340. Through the rotation of the movement barrel 320, the minute wheel 446 makes one rotation per hour. The minute hand 462 mounted to the minute wheel 446 indicates "minute" of the time information. The second hand 460 mounted to the second wheel & pinion 442 indicates "second" of the time information. The rotation center of the second wheel & pinion 442 and the rotation center of the minute wheel 446 are at the same position. Through rotation of the minute wheel 446, the minute wheel 166 rotates. Through the rotation of the minute wheel 166, the hour wheel 180 makes one rotation in 12 hours. The hour hand 464 mounted to the hour wheel 180 indicates the "hour" of the time information.

(7.2) Calendar Feeding Operation:

(7.2.1) Operation in a "Longer Month" Other Than that at the Month End:

Next, the calendar feeding operation of the watch with a calendar mechanism of the present invention will be described. Referring to FIGS. 1 through 3 and FIG. 26, except for the month end of a "longer month," the lever elongated hole 282C of the shorter month end feeding lever 282 is guided by the date indicator driving wheel pin 102P, and the shorter month end feeding cam 284 of the month feeding lever 270 is arranged at a position where it can come into contact with the month cam 248 of the month indicator 240, and the shorter month end feeding lever 282 can be situated at a position radially on the outer side of the main plate 102 (the position shown in FIG. 1). The shorter month end feeding lever 282 can freely move between the radially outer position of the main plate 102 and the radially inner position of the main plate 102. The month end tooth 288 of the date indicator 220 is arranged at a position where it does not come into contact with the month feeding operation portion 270C of the month feeding lever 270.

When, in this state, the date indicator driving wheel 210 rotates through rotation of the first intermediate date wheel 265, which is rotated by the rotation of the hour wheel 180, and through rotation of the second intermediate date wheel 266, the date feeding finger 212 and the lever driving pin 211 also rotate. When the date feeding finger 212 rotates, the date feeding portion 213 of the date feeding finger 212 can feed the date indicator tooth portion 226 of the date indicator 220 counterclockwise by only one tooth. The watch may be constructed such that the operation of date feeding can be conducted between, for example, 8 p.m. and 12 p.m. In this state, even when the date indicator 220 rotates, the month feeding lever 270 does not operate. The position of the date indicator 220 in the rotating direction after the operation of date feeding is set by the date jumper 260.

In this state, when the date indicator driving wheel 210 and the lever driving pin 211 rotate, the shorter month end feeding lever 282 rotates around the date indicator driving wheel pin 102P; however, the shorter month end feeding finger 286 of the shorter month end feeding lever 282 is arranged at a position where it does not come into contact with the month end tooth 288 of the date indicator 220. Thus, in this state, even when the shorter month end feeding lever 282 rotates, the date indicator 220 does not rotate. Thus, except for the end of a "longer month," the date indicator tooth portion 226 of the date indicator 220 is fed by only one tooth, and the date display is changed by only one day. Except for the end of a "longer month," no month feeding is effected, so that the month display is not changed.

(7.2.2) Operation in a "Shorter Month" Except for that at the End of the Month

Figure 2:
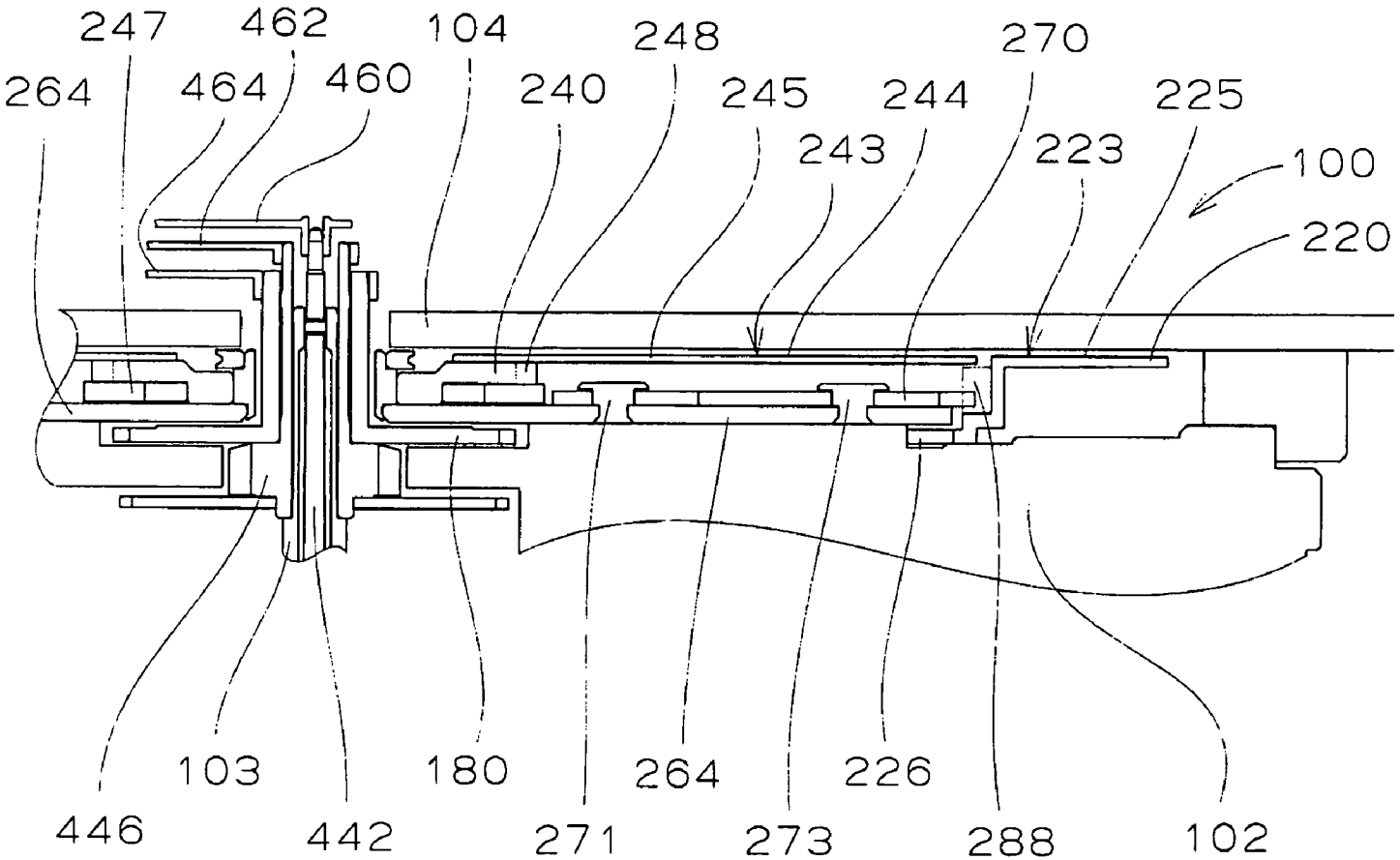
FIG. 2 is a partial sectional view of an hour wheel, a month feeding mechanism, etc. in an embodiment of the watch with a calendar mechanism of the present invention.
Figure 3:
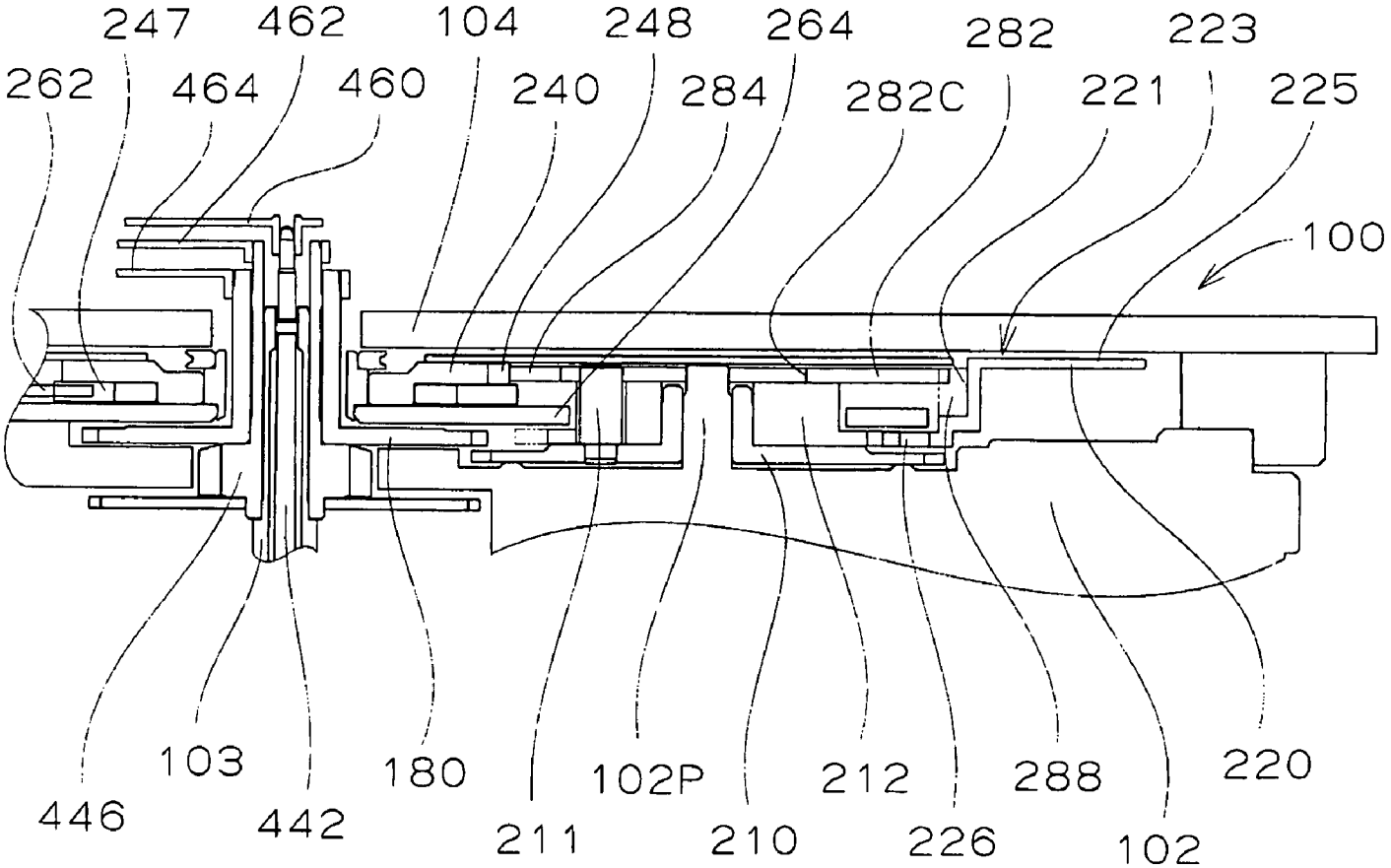
FIG. 3 is a partial sectional view of an hour wheel, a date feeding mechanism, a shorter month end feeding lever, etc. in an embodiment of the watch with a calendar mechanism of the present invention.
Figure 26:
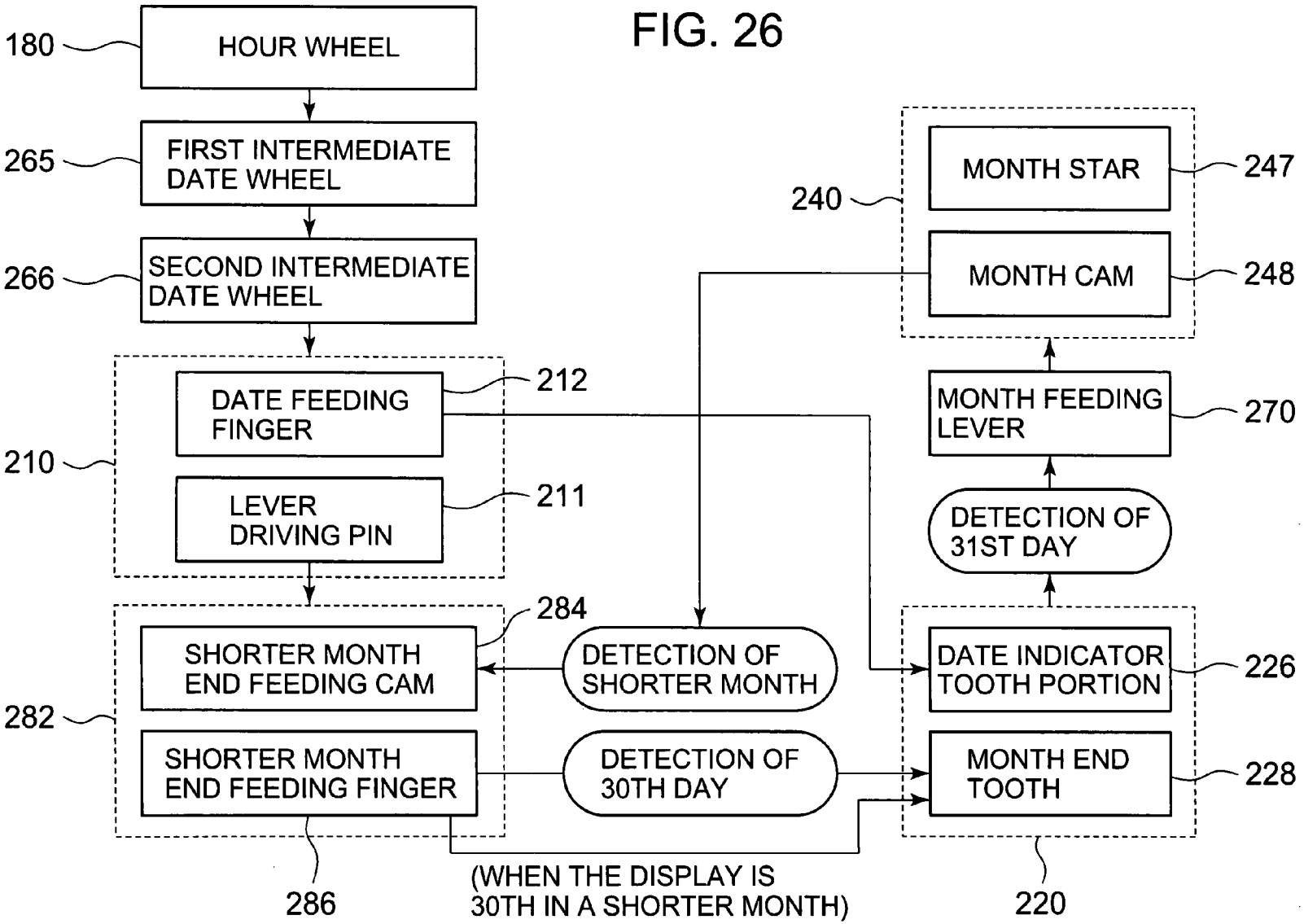
FIG. 26 is a schematic block diagram showing the construction of a calendar mechanism in an embodiment of the watch with a calendar mechanism of the present invention.
Figure 27:
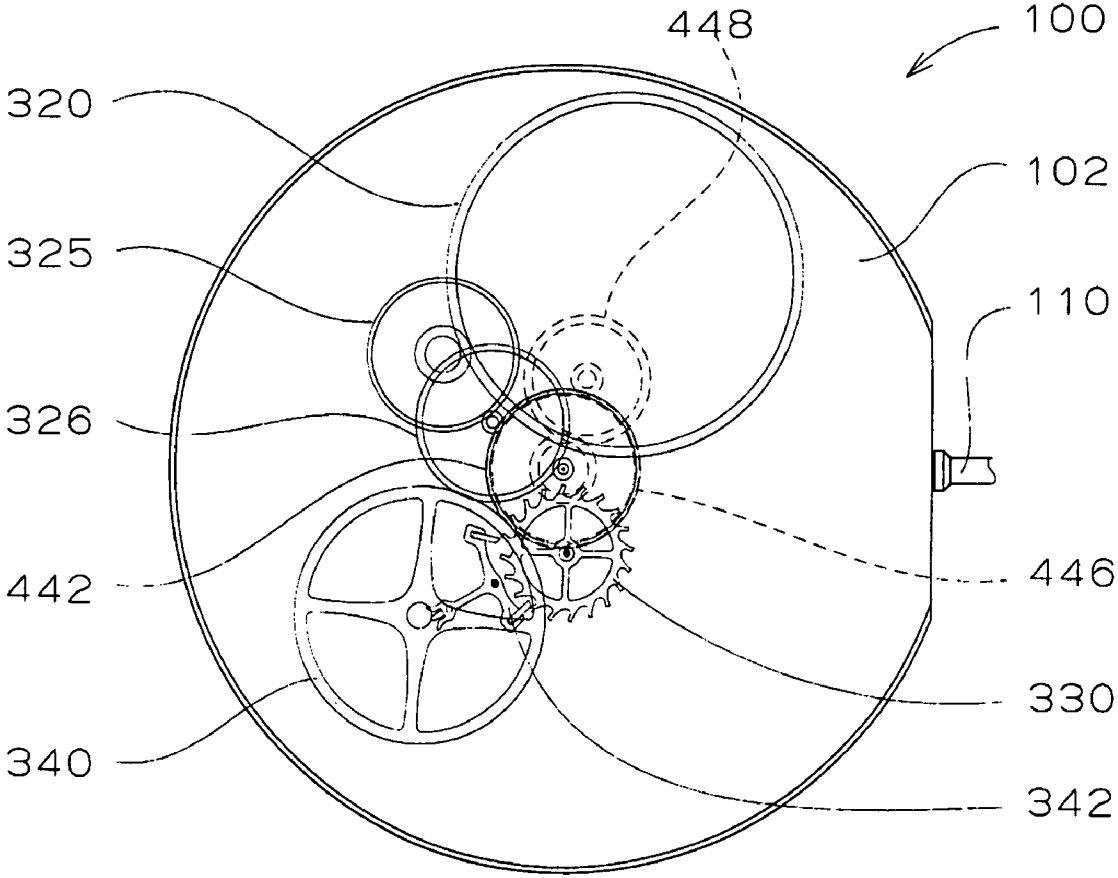
FIG. 27 is a schematic plan view showing the construction of a movement consisting of a mechanical watch as seen from the case back side in a first embodiment of the watch with a calendar mechanism of the present invention.

Referring to FIGS. 2 and 3 and FIG. 26, except for the month end of a "shorter month," the lever elongated hole 282C of the shorter month end feeding lever 282 is guided by the date indicator driving wheel pin 102P, and the shorter month end feeding cam 284 of the shorter month end feeding lever 282 is arranged at a position corresponding to the shorter month detecting cam 249 of the month indicator 240.

In this state, when the date indicator driving wheel 210 and the lever driving pin 211 rotate, the shorter month end feeding lever 282 rotates around the date indicator driving wheel pin 102P; however, the shorter month end driving finger of the shorter month end feeding lever 282 is arranged at a position where it does not come into contact with the month end tooth 288 of the date indicator 220. In this state, even when the shorter month end feeding lever 282 rotates, the date indicator 220 does not rotate. Thus, except for the end of a "shorter month," the date indicator tooth portion 226 of the date indicator 220 is fed by only one tooth, and the date display is changed by only one day. The position of the date indicator 220 in the rotating direction after the date feeding operation is set by the date jumper 260. Except for the month end of a "shorter month," no month feeding is effected, so that the month indication does not change. That is, the operation in a "shorter month" except for that at the month end is the same as the operation in a "longer month" except for that at the month end.

Figure 5:
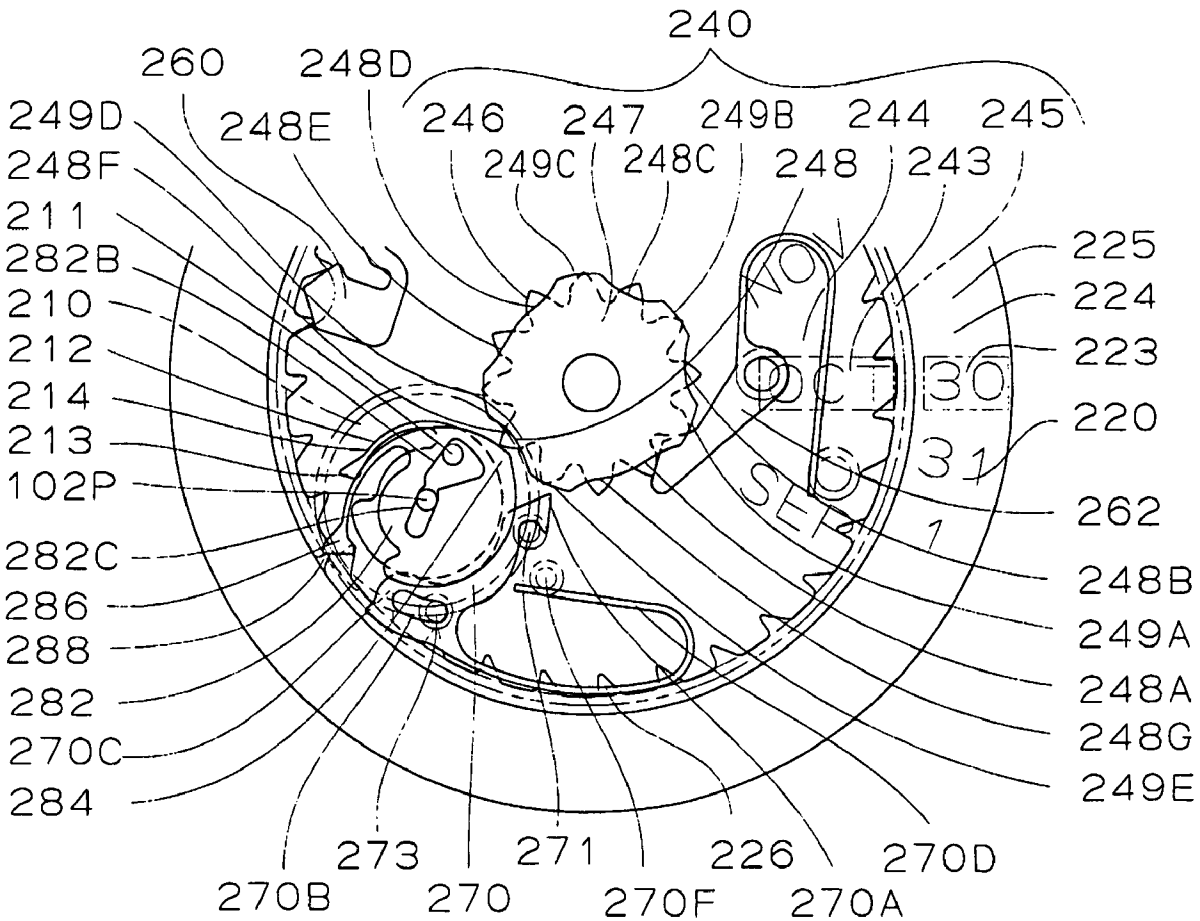
FIG. 5 is a partial plan view (1) showing the construction of a date feeding mechanism and a month feeding mechanism when the display changes from October 30 to October 31 in an embodiment of the watch with a calendar mechanism of the present invention.

(7.2.3) Operation of Changing from "30th Day" to "31st Day" in a "Longer Month":

Referring to FIGS. 5 through 9 and FIG. 26, in the state in which the "30th day" of a "longer month" is displayed, the month display is "OCT," which corresponds to "October." The shorter month end feeding lever 282 can be arranged at a radially outer position of the main plate 102 (the position shown in FIG. 5). The shorter month end feeding lever 282 can freely move between the radially inner position of the main plate 102 and the radially outer position of the main plate 102. The month end tooth 288 of the date indicator 220 is arranged at a position where it does not come into contact with the month feeding operation portion 270C of the month feeding lever 270.

Figure 6:
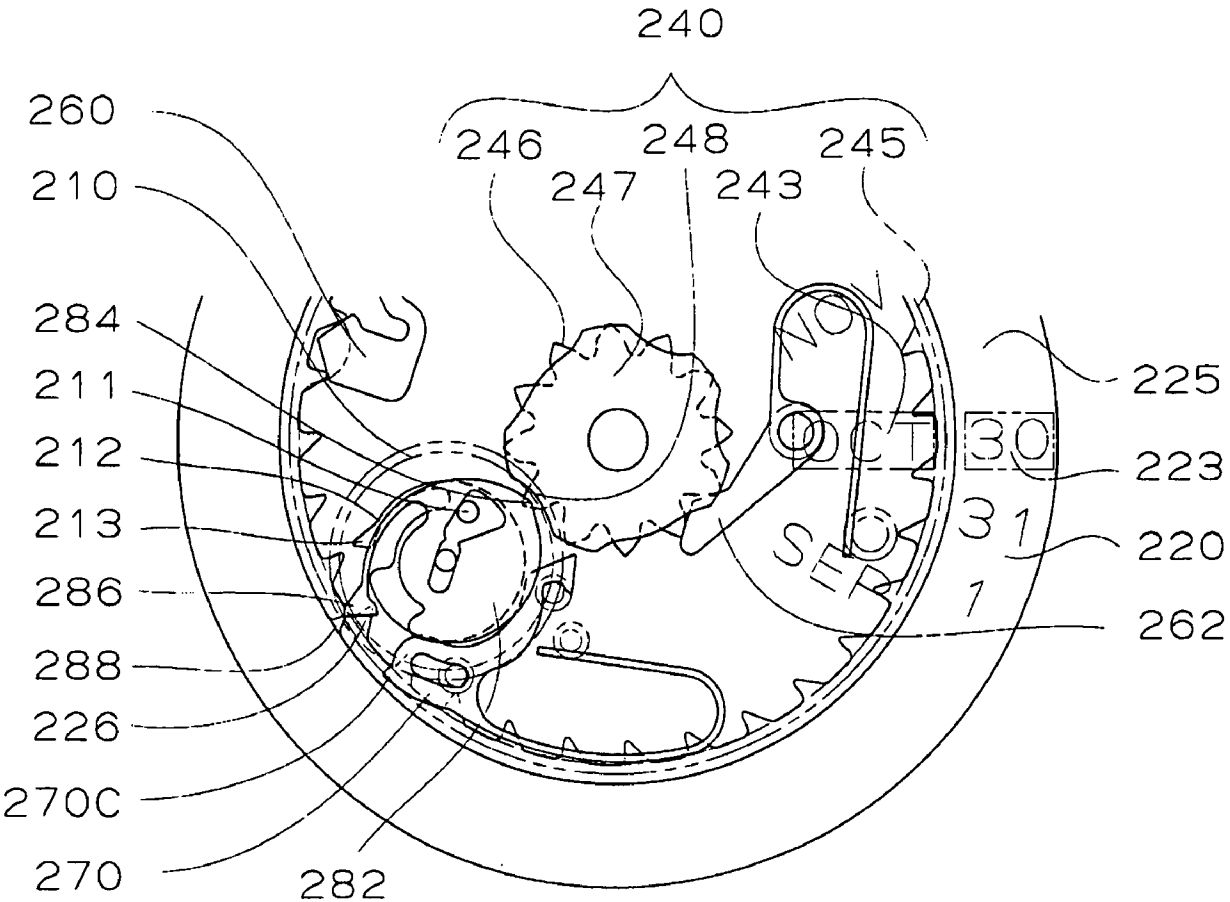
FIG. 6 is a partial plan view (2) showing the construction of a date feeding mechanism and a month feeding mechanism when the display changes from October 30 to October 31 in an embodiment of the watch with a calendar mechanism of the present invention.

Referring to FIG. 6, when the date indicator driving wheel 210 rotates through rotation of the first intermediate date wheel 265, which rotates through rotation of the hour wheel 180, and through rotation of the second intermediate date wheel 266, the date feeding finger 212 and the lever driving pin 211 also rotate at the same time. When the date feeding finger 212 rotates, the date feeding portion 213 of the date feeding finger 212 can rotate counterclockwise so as to approach the date indicator tooth portion 226 of the date indicator 220.

In this state, when the date indicator driving wheel 210 and the lever driving pin 211 rotate, the shorter month end feeding lever 282 rotates around the date indicator driving wheel pin 102P, and the shorter month end feeding finger 286 of the shorter month end feeding lever 282 comes into contact with the month end tooth 288 of the date indicator 220. The shorter month end feeding lever 282 is moved toward the radially inner position of the main plate 102 by the month end tooth 288 of the date indicator 220. Thus, in this state, even when the shorter month end feeding lever 282 rotates, the date indicator 220 does not rotate.

Figure 7:
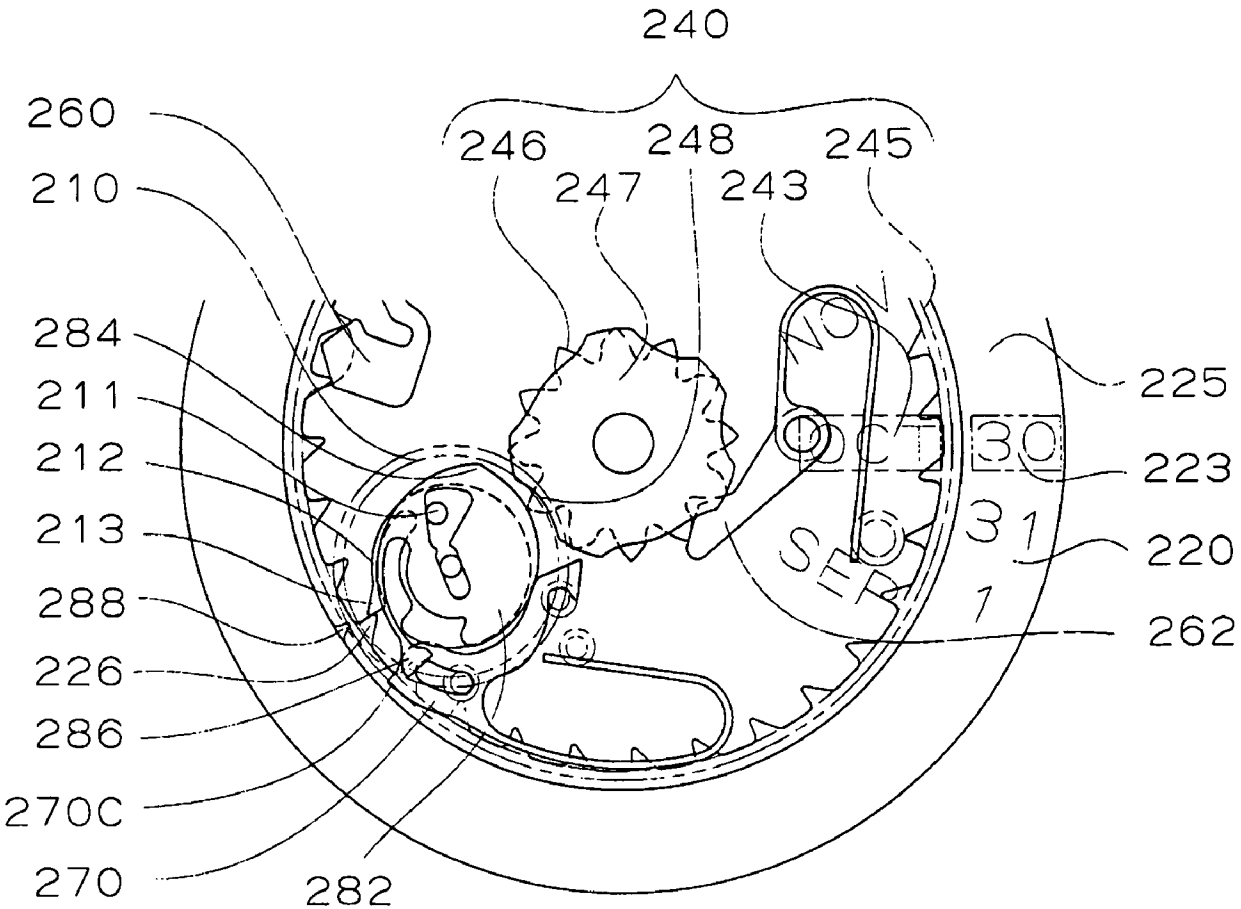
FIG. 7 is a partial plan view (3) showing the construction of a date feeding mechanism and a month feeding mechanism when the display changes from October 30 to October 31 in an embodiment of the watch with a calendar mechanism of the present invention.

Referring to FIG. 7, when the date indicator driving wheel 210 further rotates, the date feeding finger 212 further rotates, and the date feeding portion 213 of the date feeding finger 212 comes into contact with one tooth of the date indicator tooth portion 226 of the date indicator 220. The month end tooth 288 of the date indicator 220 is arranged at a position where it does not come into contact with the month feeding operation portion 270C of the month feeding lever 270.

Figure 8:
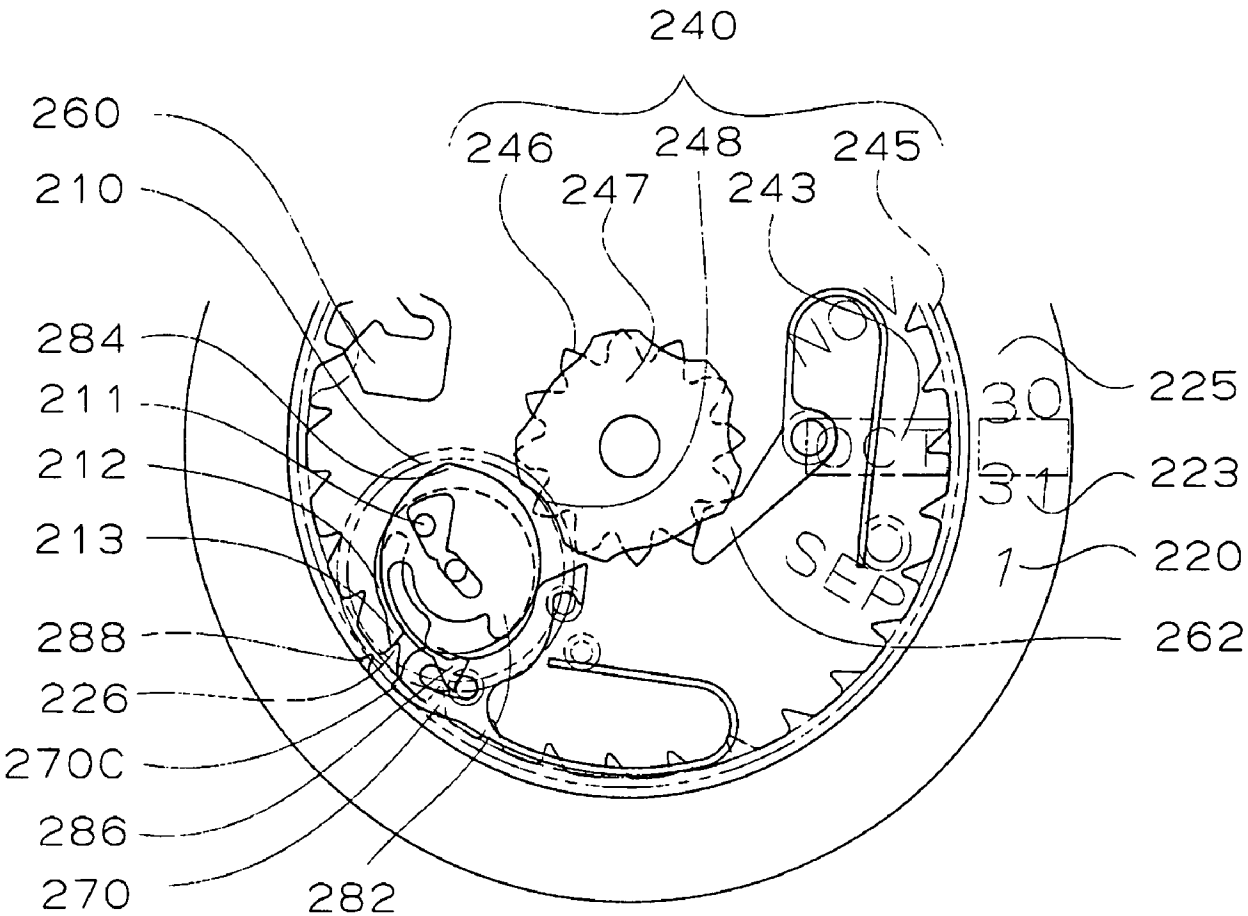
FIG. 8 is a partial plan view (4) showing the construction of a date feeding mechanism and a month feeding mechanism when the display changes from October 30 to October 31 in an embodiment of the watch with a calendar mechanism of the present invention.

Referring to FIG. 8, when the date indicator driving wheel 210 further rotates, the date feeding finger 212 further rotates, and the date indicator tooth portion 226 of the date indicator 220 can be fed counterclockwise by only one tooth. The position of the date indicator 220 in the rotating direction after the date feeding operation is set by the date jumper 260. The month end tooth 288 of the date indicator 220 is arranged at a position where it does not come into contact with the month feeding operation portion 270C of the month feeding lever 270.

Figure 9:
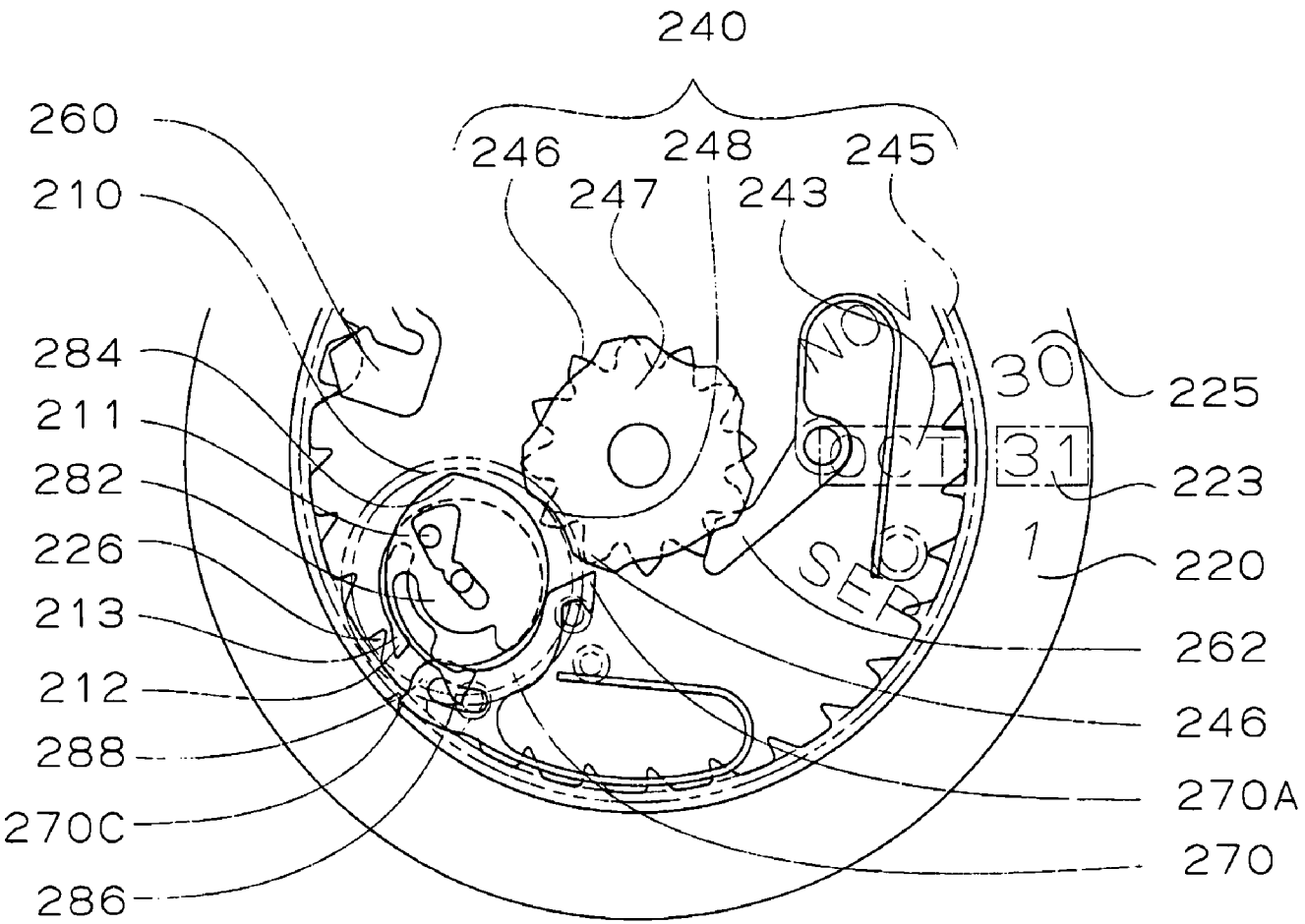
FIG. 9 is a partial plan view (5) showing the construction of a date feeding mechanism and a month feeding mechanism when the display changes from October 30 to October 31 in an embodiment of the watch with a calendar mechanism of the present invention.

Referring to FIG. 9, the date feeding finger 212 has fed the date indicator tooth portion 226 of the date indicator 220 counterclockwise by one tooth, and the date display is changed to "31st day." The month end tooth 288 of the date indicator 220 is arranged at a position where it comes into contact with the month feeding operation portion 270C of the month feeding lever 270, or at a position where it does not come into contact with the month feeding operation portion 270C of the month feeding lever 270; however, the month feeding portion 270A of the month feeding lever 270 does not come into contact with the month star tooth portion 246 of the month indicator 240. Thus, when transition is effected from the state in which the "30th day" of a "longer month" is displayed to the state in which "31st day" thereof is displayed, no month feeding is effected, so that the month display does not change but remains "OCT." The operation of changing from the "30th day" to the "31st day" of a longer month other than "October" is the same as the operation of changing from the "30th day" to the "31st day" of "October."

Figure 10:
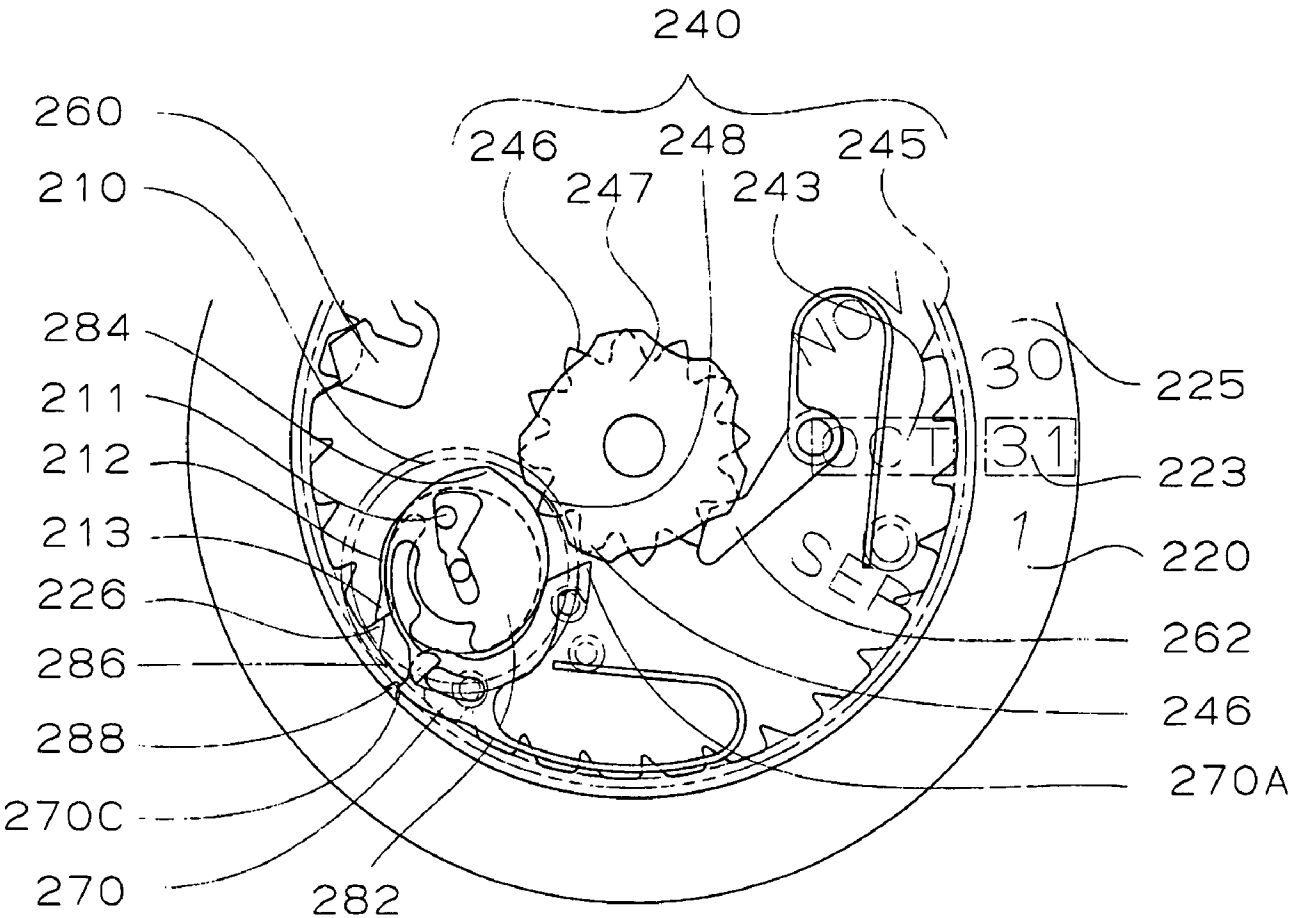
FIG. 10 is a partial plan view (1) showing the construction of a date feeding mechanism and a month feeding mechanism when the display changes from October 31 to November 1 in an embodiment of the watch with a calendar mechanism of the present invention.

(7.2.4) Operation of Changing from the "31st day" of a "Longer Month" to the "1st day" of the Next Month:

Referring to FIGS. 2 and 3, FIG. 10, and FIG. 26, in the state in which the "31st day" of a "longer month" is displayed, the month display is "OCT," which corresponds to "October." In this state, the shorter month end feeding lever 282 can be arranged at a position on the radially outer side of the main plate 102 (the position as shown in FIG. 10). The shorter month end feeding lever 282 can freely move between the radially outer position of the main plate 102 and the radially inner position of the main plate 102. The month end tooth 288 of the date indicator 220 is arranged at a position where it can come into contact with the month feeding operation portion 270C of the month feeding lever 270.

Figure 11:
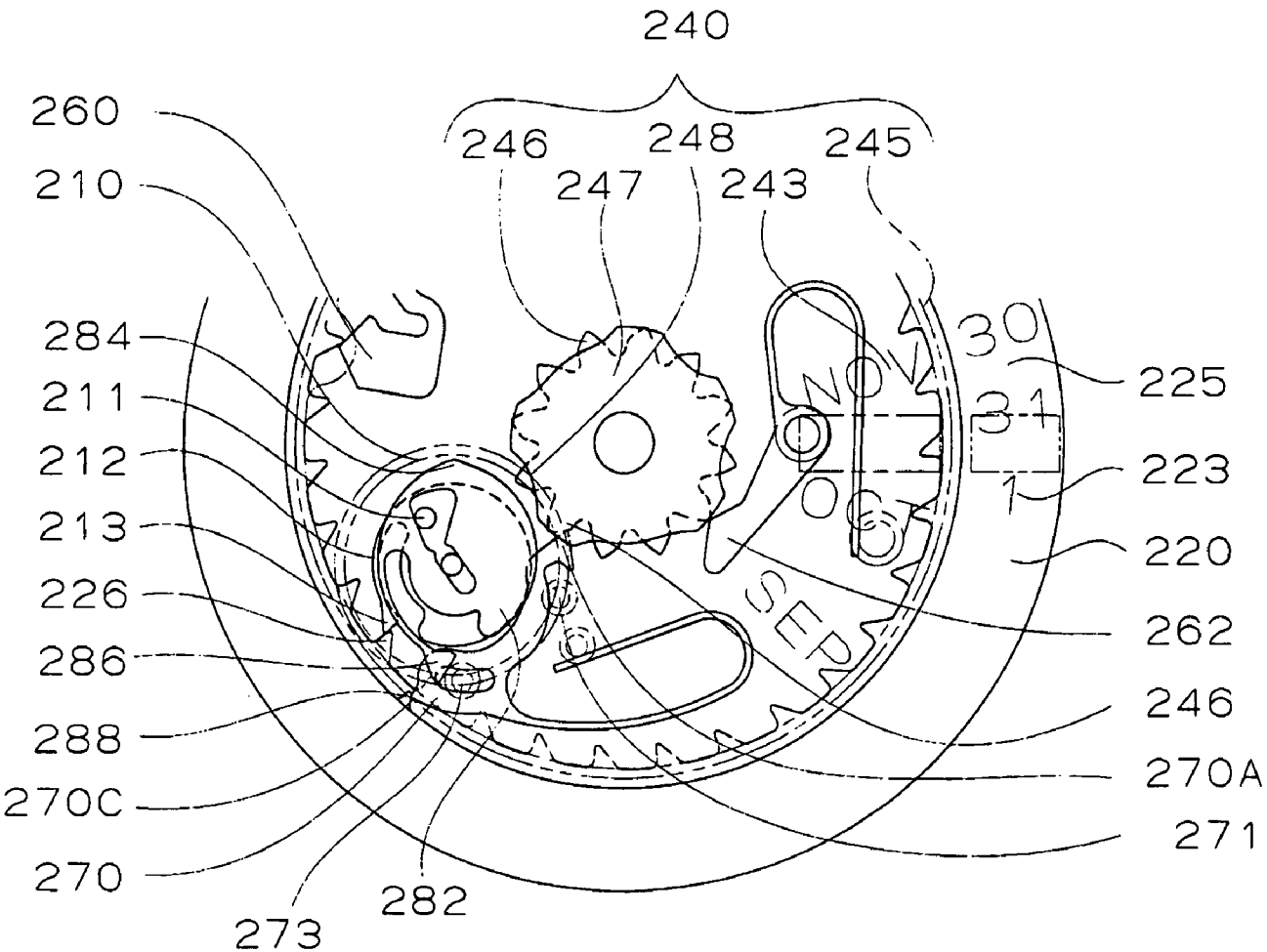
FIG. 11 is a partial plan view (2) showing the construction of a date feeding mechanism and a month feeding mechanism when the display changes from October 31 to November 1 in an embodiment of the watch with a calendar mechanism of the present invention.

Referring to FIG. 11 and FIG. 26, when the date indicator driving wheel 210 rotates through rotation of the first intermediate date wheel 265, which rotates through rotation of the hour wheel 180, and through rotation of the second intermediate date wheel 266, the date feeding finger 212 and the lever driving pin 211 also rotate at the same time. When the date feeding finger 212 rotates, the date feeding portion 213 of the date feeding finger 212 can rotate counterclockwise so as to approach the date indicator tooth portion 226 of the date indicator 220. In this state, when the date indicator 220 rotates counterclockwise, the month end tooth 288 of the date indicator 220 comes into contact with the month feeding operation portion 270C of the month feeding lever 270. When the month end tooth 288 of the date indicator 220 is arranged at this position, the month feeding lever 270 can move toward the month star tooth portion 246. When the month feeding lever 270 moves toward the month star tooth portion 246 and comes into contact with the month feeding portion 270A, the month star tooth portion 246 rotates clockwise.

In this state, when the date indicator driving wheel 210 and the lever driving pin 211 rotate, the shorter month end feeding lever 282 rotates around the date indicator driving wheel pin 102P; however, the shorter month end feeding finger 286 of the shorter month end feeding lever 282 does not come into contact with the month end tooth 288 of the date indicator 220. Thus, in this state, even when the shorter month end feeding lever 282 rotates, the date indicator 220 does not rotate.

Figure 12:
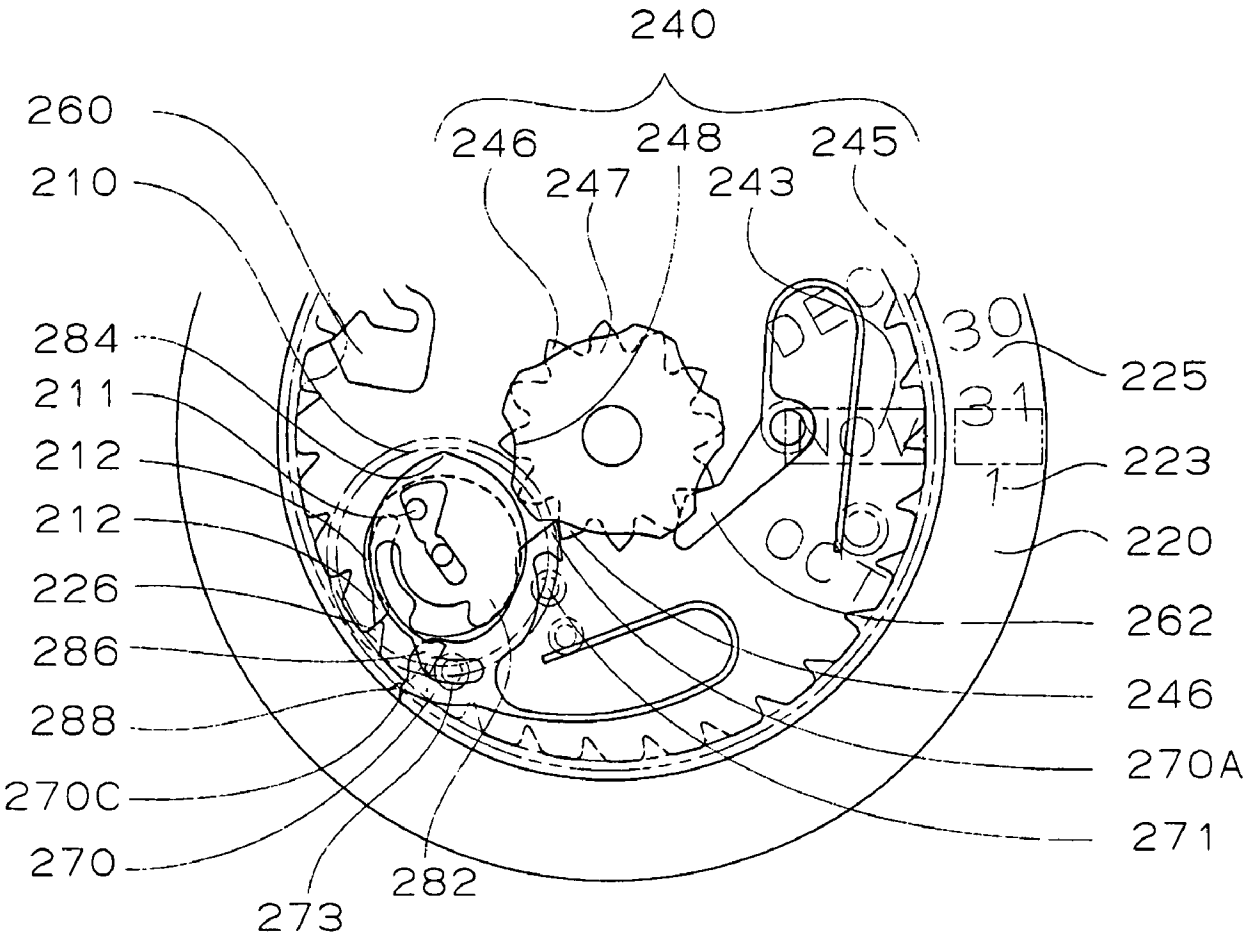
FIG. 12 is a partial plan view (3) showing the construction of a date feeding mechanism and a month feeding mechanism when the display changes from October 31 to November 1 in an embodiment of the watch with a calendar mechanism of the present invention.

Referring to FIG. 12, when the date indicator driving wheel 210 further rotates, the date feeding finger 212 further rotates. Due to the month end tooth 288 of the date indicator 220, the month feeding lever 270 moves toward the month star tooth portion 246 to come into contact with the month feeding portion 270A, and the month star tooth portion 246 can be fed clockwise by only one tooth. The position of the month indicator 240 in the rotating direction after the month feeding operation is set by the month jumper 262.

Figure 13:
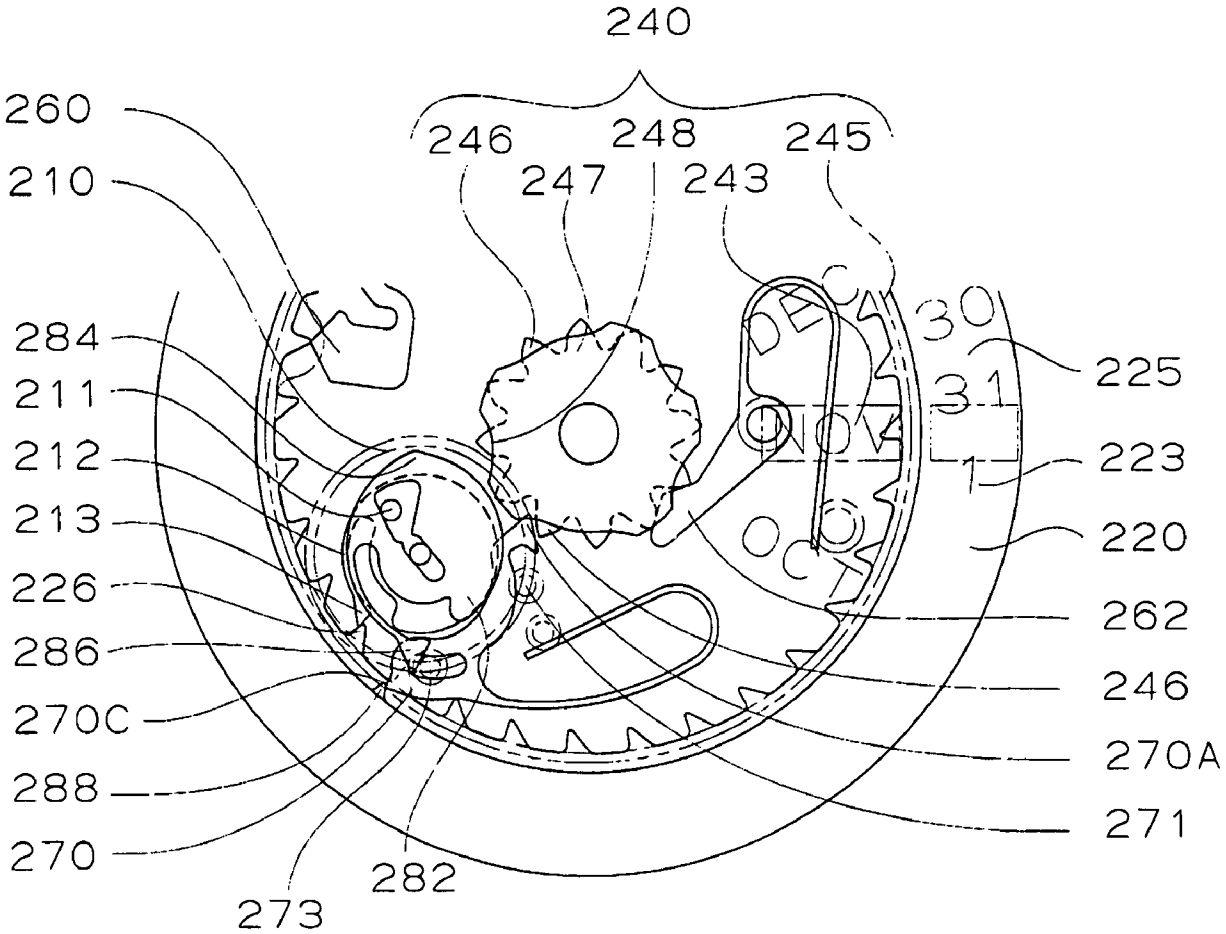
FIG. 13 is a partial plan view (4) showing the construction of a date feeding mechanism and a month feeding mechanism when the display changes from October 31 to November 1 in an embodiment of the watch with a calendar mechanism of the present invention.

Referring to FIG. 13, when the date indicator driving wheel 210 rotates, the date feeding finger 212 further rotates, and the date indicator tooth portion 226 of the date indicator 220 can be fed counterclockwise by only one tooth. The position of the date indicator 220 in the rotating direction after the date feeding operation is set by the date jumper 260.

Figure 14:
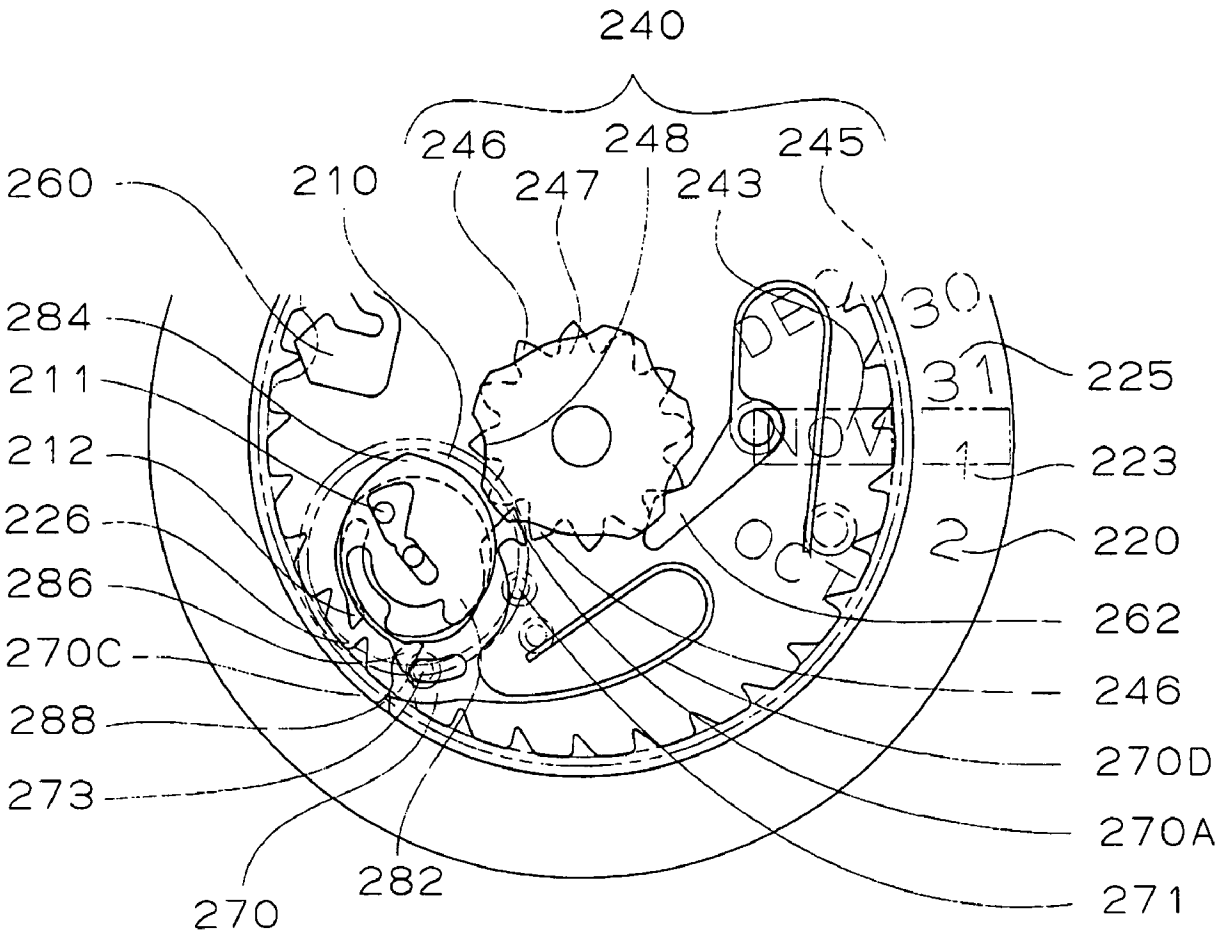
FIG. 14 is a partial plan view (5) showing the construction of a date feeding mechanism and a month feeding mechanism when the display changes from October 31 to November 1 in an embodiment of the watch with a calendar mechanism of the present invention.

Referring to FIG. 14, when the date indicator driving wheel 210 further rotates, the date feeding finger 212 further rotates, and the month end tooth 288 of the date indicator 220 is detached from the month feeding operation portion 270C of the month feeding lever 270. Due to the resilient force of the spring portion 270D of the month feeding lever, the month feeding lever 270 moves away from the month wheel 242.

Figure 15:
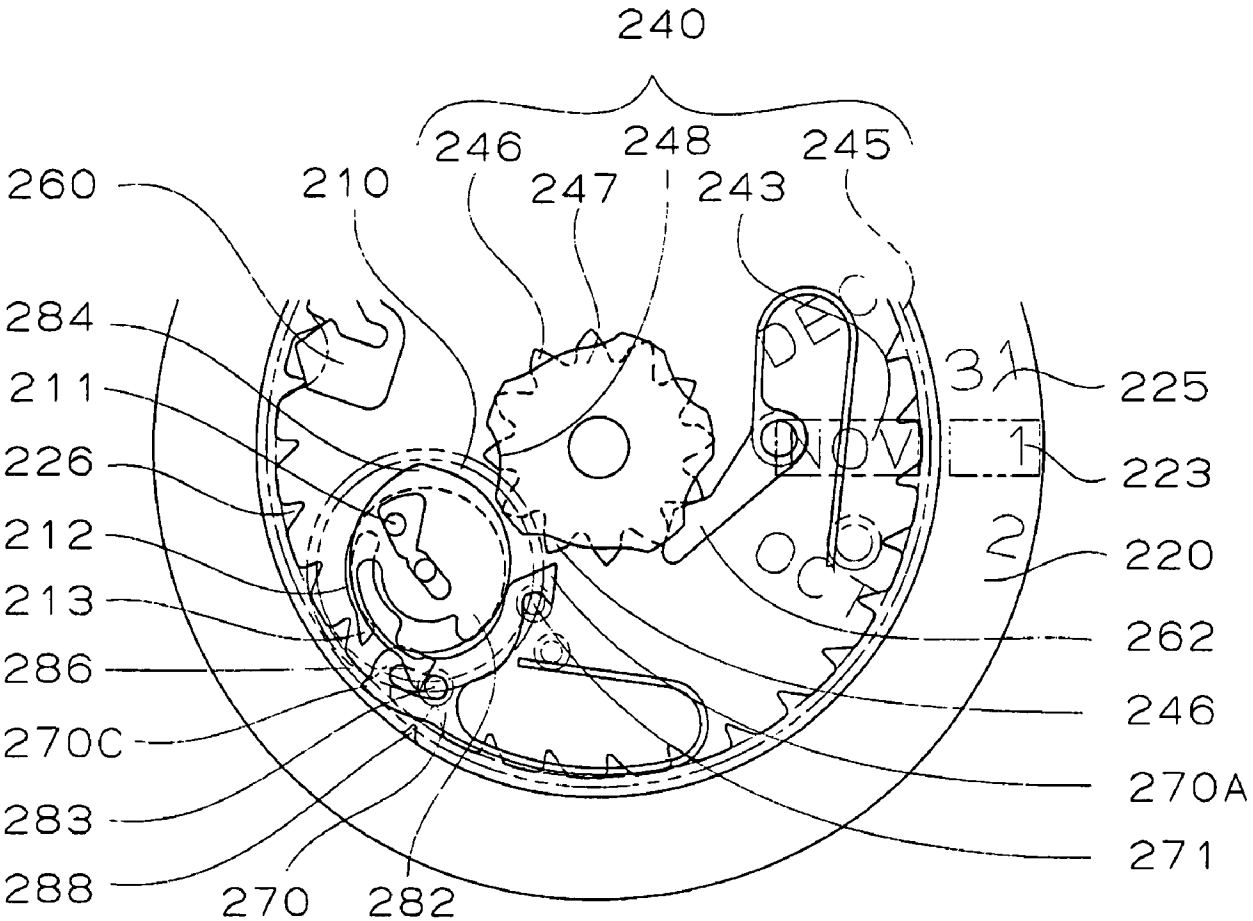
FIG. 15 is a partial plan view (6) showing the construction of a date feeding mechanism and a month feeding mechanism when the display changes from October 31 to November 1 in an embodiment of the watch with a calendar mechanism of the present invention.

Referring to FIG. 15, the date feeding finger 212 has fed the date indicator tooth portion 226 of the date indicator 220 counterclockwise by only one tooth, and the date display is changed to "1st day." Through the movement of the month feeding lever 270, the month end tooth 288 of the date indicator 220 has fed the month star tooth portion 246 of the month star 247 clockwise by only one tooth, and the month display is changed to "NOV." The operation of the date feeding and month feeding can be performed, for example, between 8 p.m. and 12 p.m. The operation at the end of a "longer month" other than "October" is the same as the operation at the end of "October."

Figure 16A:
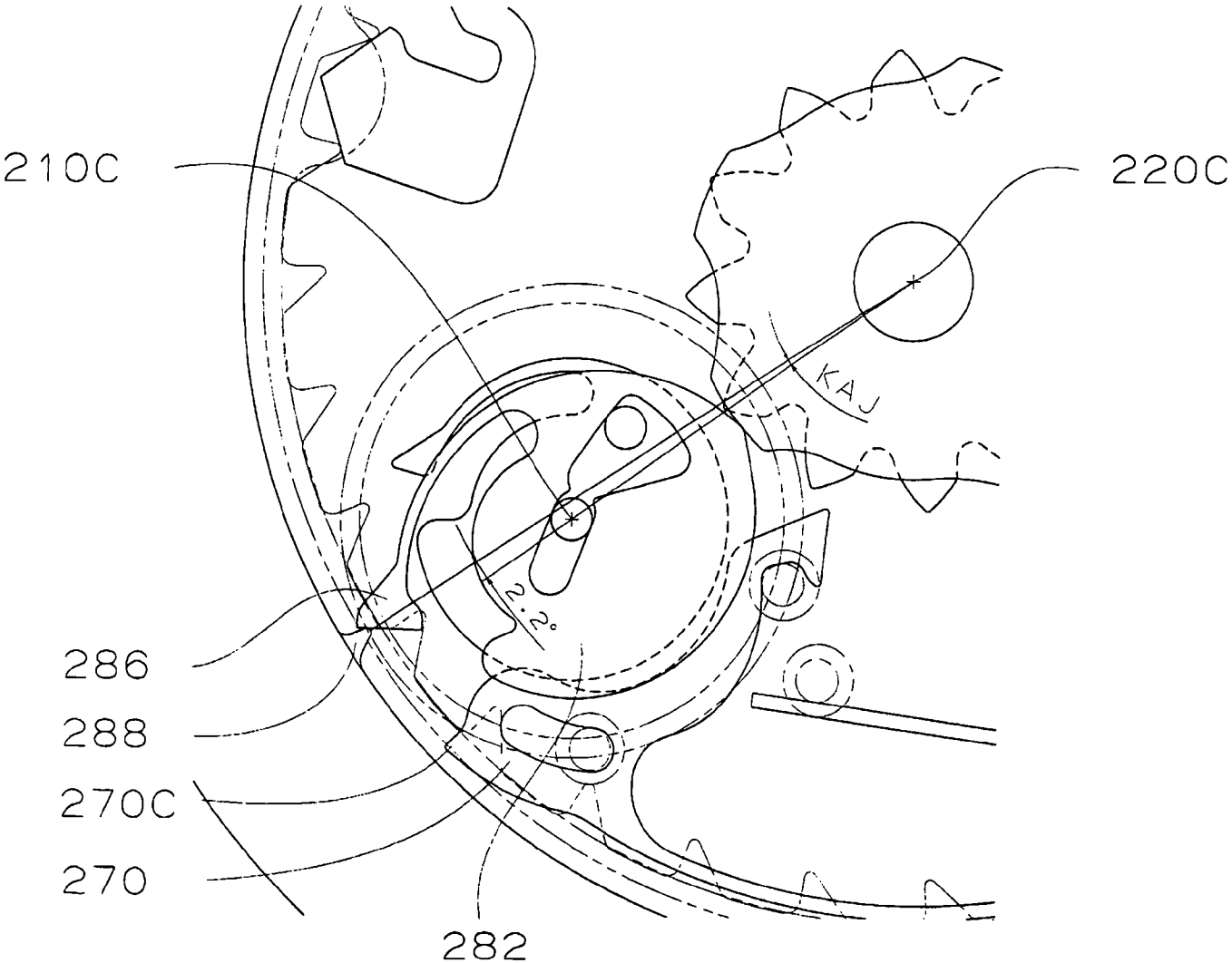
FIG. 16A is a partially enlarged plan view showing how a shorter month end feeding finger is held in contact with a month end tooth when the display changes from November 30 to December 1 in an embodiment of the watch with a calendar mechanism of the present invention.
Figure 16B:
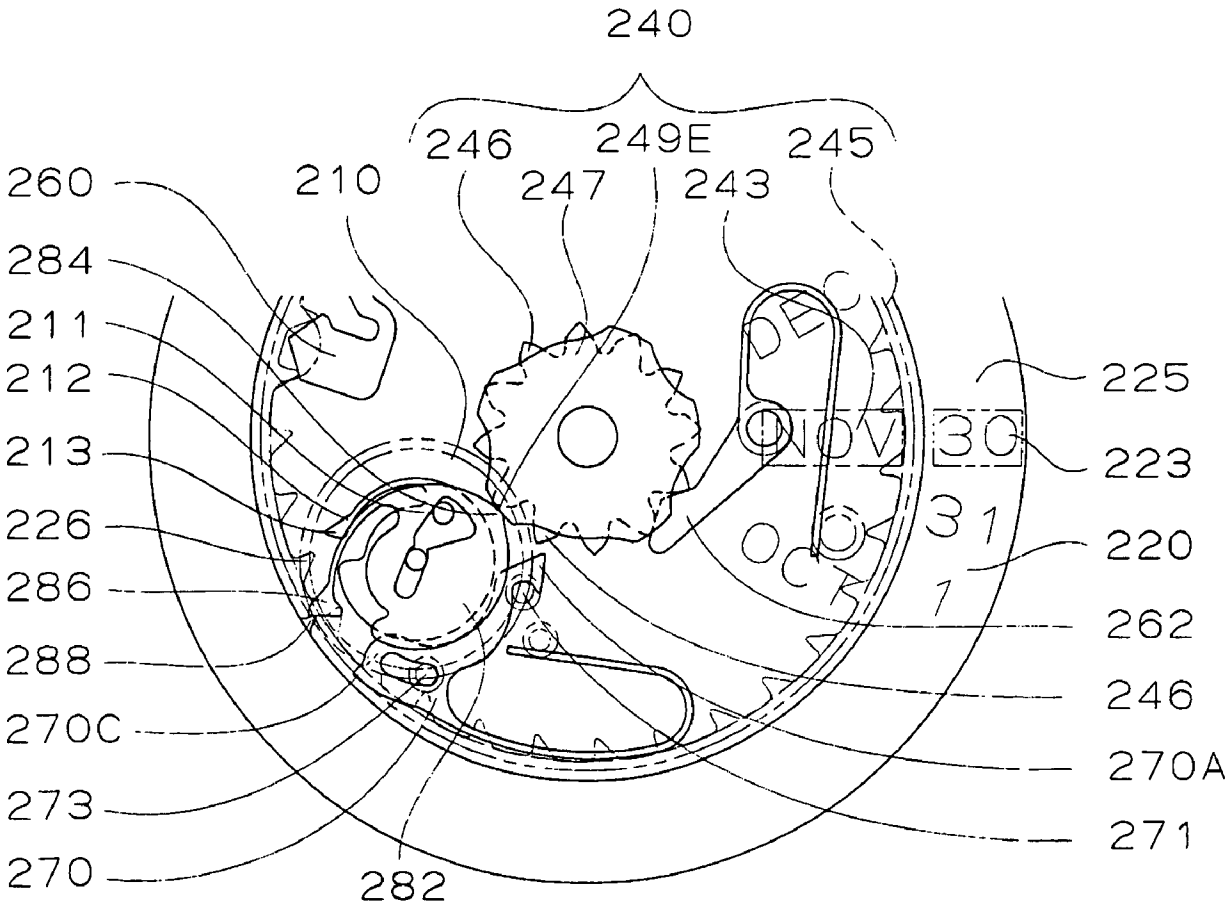
FIG. 16B is a partial plan view (1) showing the construction of a date feeding mechanism and a month feeding mechanism when the display changes from November 30 to December 1 in an embodiment of the watch with a calendar mechanism of the present invention.

(7.2.5) Operation of Changing from the "30th Day" of a "Shorter Month" to the "1st Day" of the Next Month:

Referring to FIGS. 1 through 3, FIG. 16B, and FIG. 26, in the state in which the "30th day" of a "shorter month" is displayed, the month display is "NOV," which corresponds to "November," and the date display is "30," which corresponds to "30th day." In this state, the November cam 249E of the month indicator 240 is arranged at a position where it comes into contact with the shorter month end feeding cam 284 of the shorter month end feeding lever 282. That is, the November cam 249E of the month indicator 240 is arranged at the "shorter month detecting" position. In this state, the shorter month end feeding lever 282 is arranged at the radially outer position of the main plate 102 (the position as shown in FIG. 16B). The month end tooth 288 of the date indicator 220 is arranged at a position where it does not come into contact with the month feeding operation portion 270C of the month feeding lever 270.

When the date indictor driving wheel 210 rotates through rotation of the first intermediate date wheel 265, which rotates through rotation of the hour wheel 180, and through rotation of the second intermediate date wheel 266, the date feeding finger 212 and the lever driving pin 211 also rotate at the same time. When the date feeding finger 212 rotates, the date feeding portion 213 of the date feeding finger 212 can rotate counterclockwise so as to approach the date indicator tooth portion 226 of the date indicator 220.

FIG. 16A is a partially enlarged plan view showing how, in the state in which transition is effected from November 30 to December 1, the shorter month end feeding finger 286 is held in contact with the month end tooth 288. Referring to FIG. 16A, the month end tooth distal end position angle KAJ, which is made by the straight line connecting the rotation center 220C of the date indicator 220 and the rotation center 210C of the date indicator driving wheel 210 and the straight line connecting the rotation center 220C of the date indicator 220 and the distal end portion of the month end tooth 288 preferably ranges from 0 degree to ½ of a day regulating angle. Here, the term "day regulating angle" is defined as the rotation angle by which the date indicator 220 is rotated at the time of date feeding until the distal end portion of the tooth portion of the date indicator 220 comes into contact with the distal end portion of the date jumper 260. Generally speaking, the "day regulating angle" is set so as to be ½ to ⅔ of the pitch angle (360/31 degrees) of the date indicator for one day. The "day regulating angle" assumes different values depending upon the setting of the position of the rotation center of the date jumper 260. In the state shown in FIG. 16A, the month end tooth distal end position angle KAJ is, for example, 2.2 degrees.

Figure 17A:
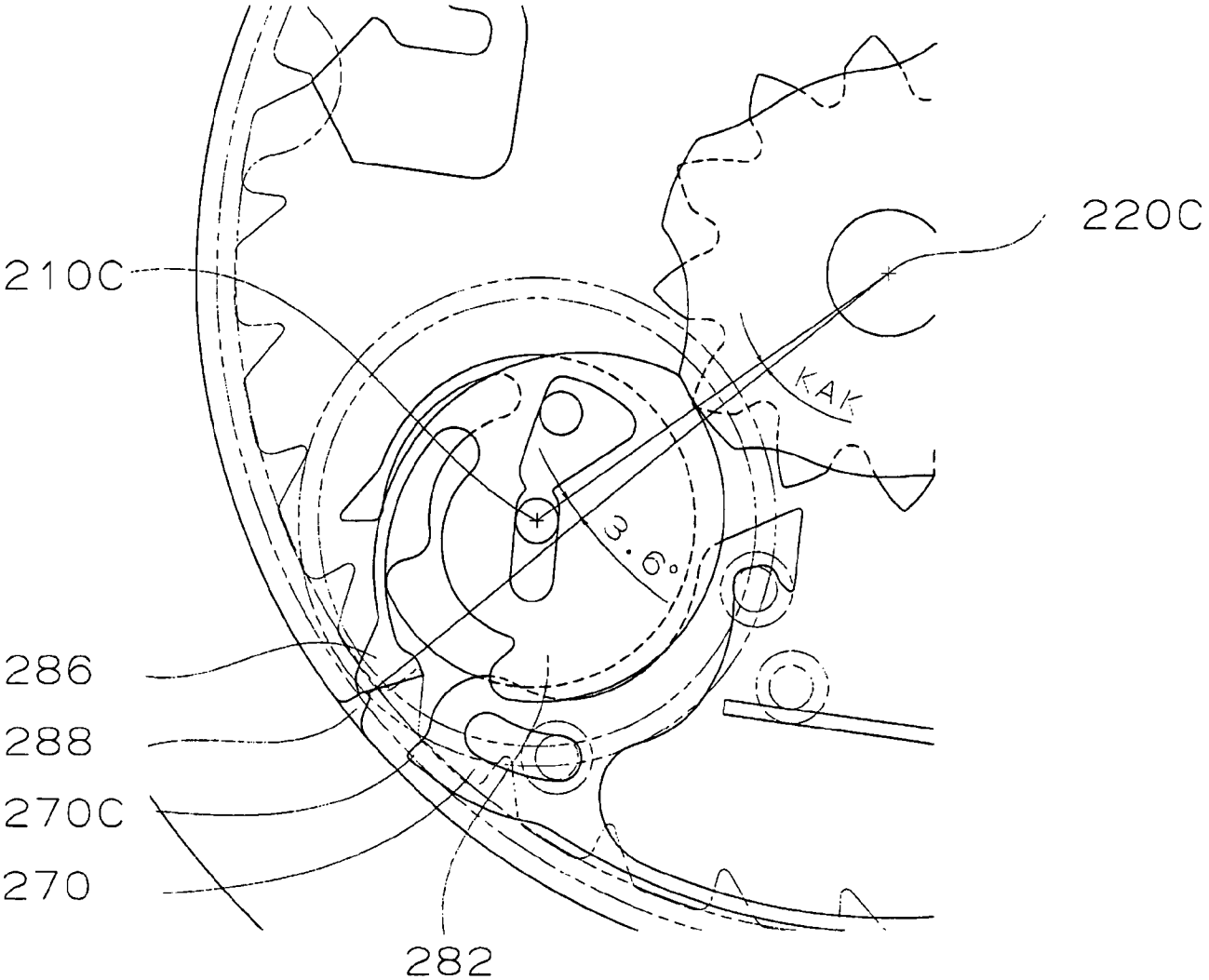
FIG. 17A is a partially enlarged plan view showing how a shorter month end feeding finger is held in contact with a month end tooth and the display is about to change to 31st when the display is changed from November 30 to 31 in an embodiment of the watch with a calendar mechanism of the present invention.
Figure 17B:
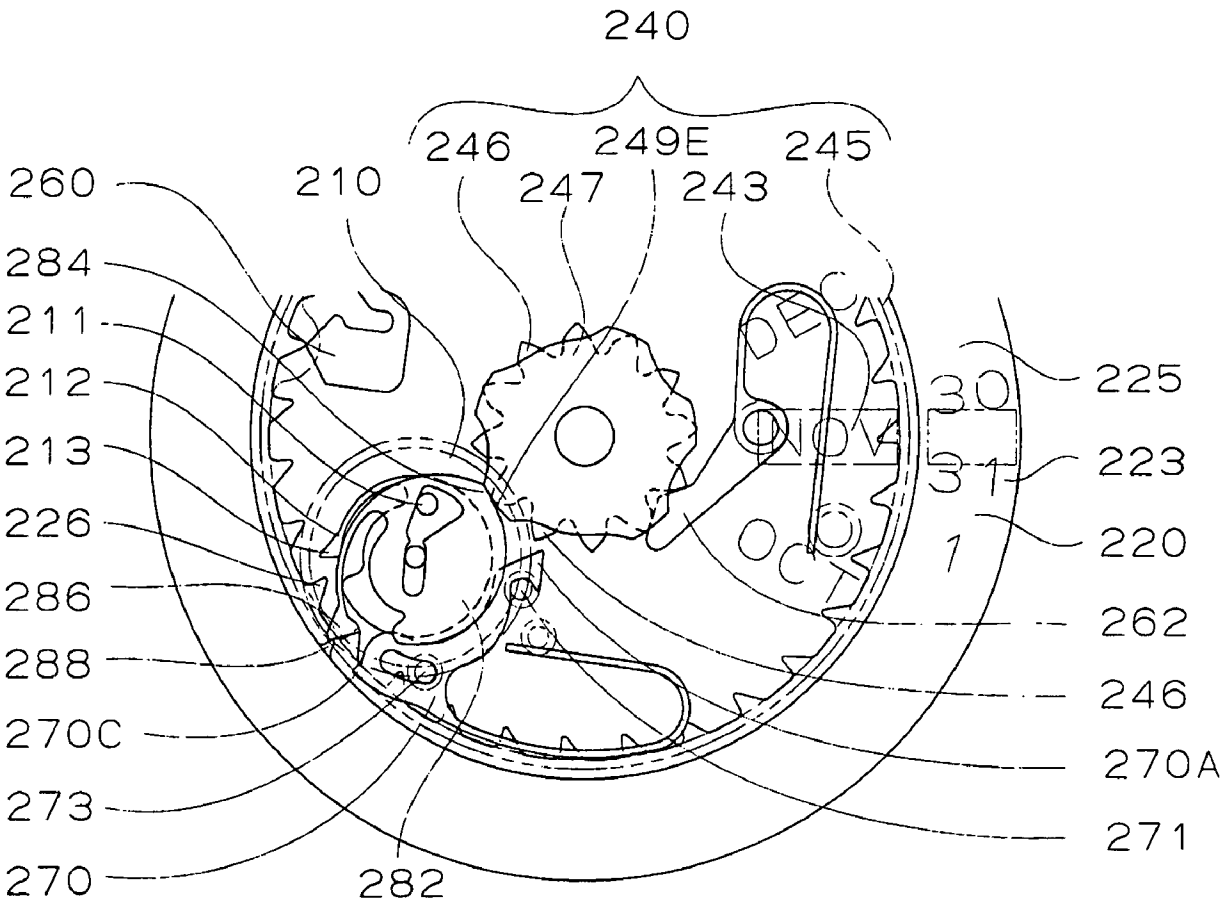
FIG. 17B is a partial plan view (2) showing the construction of a date feeding mechanism and a month feeding mechanism when the display changes from November 30 to December 1 in an embodiment of the watch with a calendar mechanism of the present invention.

Referring to FIG. 17B, when the date indicator driving wheel 210 and the lever driving pin 211 rotate, the shorter month end feeding lever 282 rotates around the date indicator driving wheel pin 102P, and the shorter month end feeding finger 286 of the shorter month end feeding lever 282 comes into contact with the month end tooth 288 of the date indicator 220. That is, in the state in which the "30th day" of a "shorter month" is displayed, when the month end tooth 288 of the date indicator 220 is arranged at this position, it is possible to rotate the date indicator 220 by the shorter month end feeding lever 282. Further, when the shorter month end feeding lever 282 rotates, the shorter month end feeding finger 286 comes into contact with the month end tooth 288 of the date indicator 220, making it possible to rotate the date indicator 220.

FIG. 17A is a partially enlarged plan view showing how, during transition from November 30 to 31, the shorter month end feeding finger comes into contact with the month end tooth and the date display is about to change to 31st day. Referring to FIG. 17A, the month end tooth distal end position angle KAK, which is made by the straight line connecting the rotation center 220C of the date indicator 220 and the rotation center 210C of the date indicator driving wheel 210 and the straight line connecting the rotation center 220C of the date indicator 220 and the distal end portion of the month end tooth 288, ranges preferably from 0 degree to ½ of the day regulating angle. In the state shown in FIG. 17A, the month end tooth distal end position angle KAK is, for example, 3.6 degrees. It is desirable for the month end tooth distal end position angle KAK in the state shown in FIG. 17A to be of much the same magnitude as the month end tooth distal end position angle KAJ in the state shown in FIG. 16A.

Figure 18A:
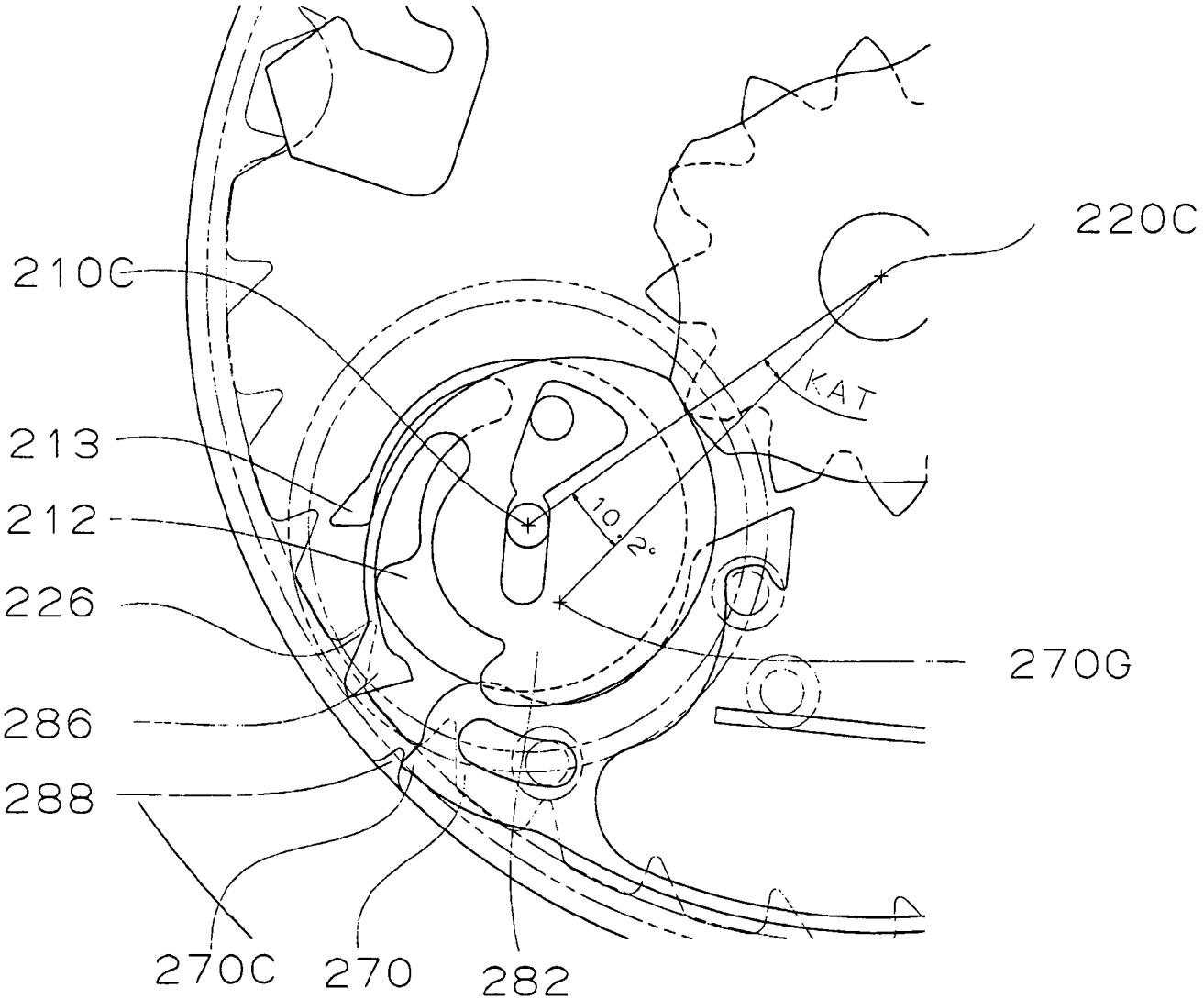
FIG. 18A is a partial enlarged plan view showing how a date indictor rotates from November 30 to display 31st day in an embodiment of the watch with a calendar mechanism of the present invention.
Figure 18B:
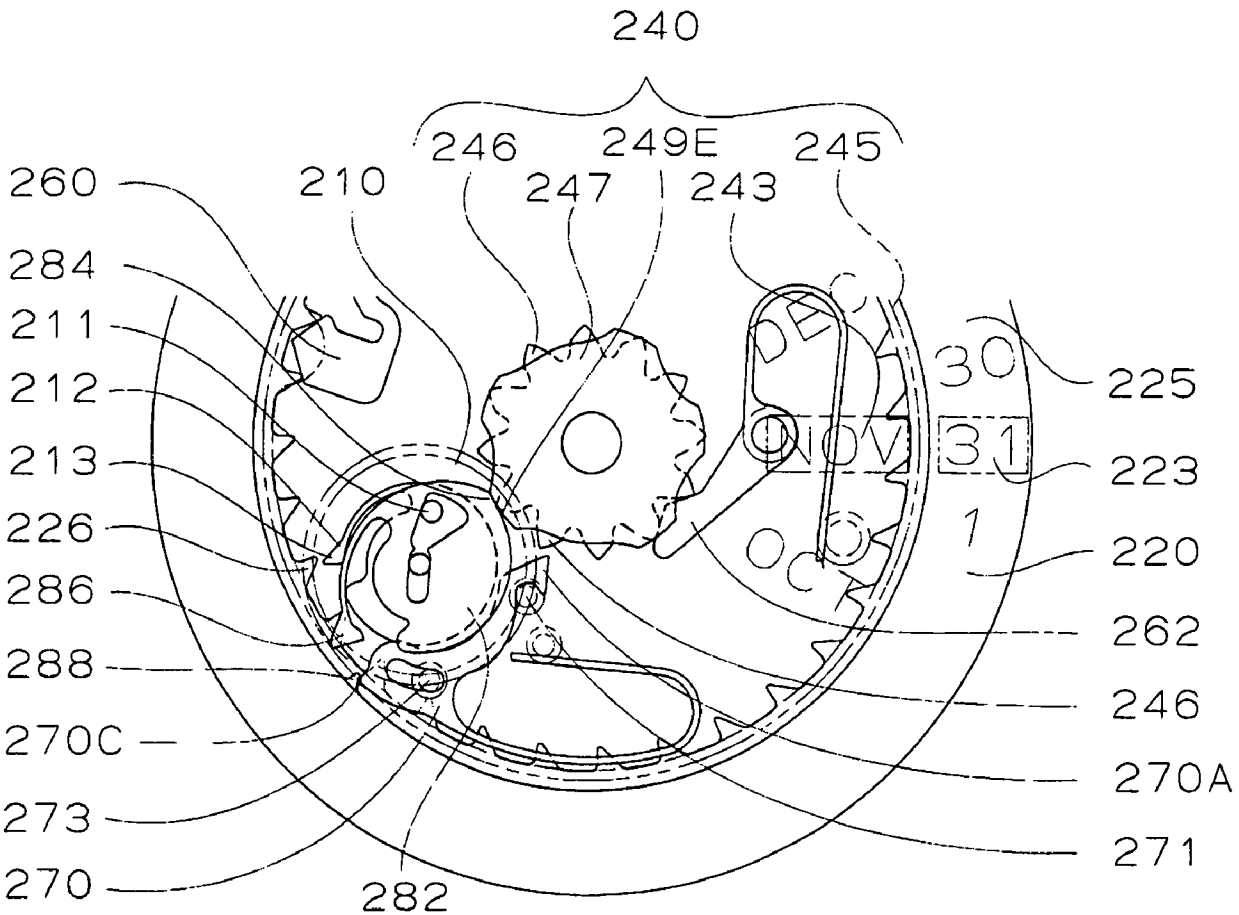
FIG. 18B is a partial plan view (3) showing the construction of a date feeding mechanism and a month feeding mechanism when the display changes from November 30 to December 1 in an embodiment of the watch with a calendar mechanism of the present invention.

Referring to FIG. 18B, when the date indicator driving wheel 210 further rotates, the date feeding finger 212 further rotates, and the date feeding portion 213 of the date feeding finger 212 approaches a tooth of the date indicator tooth portion 226 of the date indicator 220. When, in this state, the date indicator driving wheel 210 and the lever driving pin 211 rotate, the shorter month end feeding lever 282 rotates around the date indicator driving wheel pin 102P, and the shorter month end feeding finger 286 of the shorter month end feeding lever 282 comes into contact with the month end tooth 288 of the date indicator 220, rotating the date indicator 220 counterclockwise.

FIG. 18A is a partially enlarged plan view showing how the date display is changed from November 30 to 31 through rotation of the date indicator. Referring to FIG. 18A, the month feeding lever center position angle KAT, which is made by the straight line connecting the rotation center 220C of the date indicator 220 and the rotation center 210C of the date indicator driving wheel 210 and the straight line connecting the rotation center 220C of the date indicator 220 and the rotation center 270G of the month feeding lever 270, is preferably the pitch angle of the date indicator 220 for one day (360/31 degrees), or an angle not larger than the pitch angle of the date indicator 220 for one day (360/31 degrees). In the state shown in FIG. 18A, the month feeding lever center position angle KAT is, for example, 10.2 degrees. In the state shown in FIG. 18A, the month end tooth 288 of the date indicator 220 has been rotated from the state shown in FIG. 16A by the pitch angle of the date indicator 220 for one day (360/31 degrees).

Referring to FIG. 19B, when the date indicator driving wheel 210 further rotates, the shorter month end feeding lever 282 further rotates, and the date indicator tooth portion 226 of the date indicator 220 can be fed counterclockwise by only one tooth. The position of the date indicator 220 in the rotating direction after the date feeding operation is set by the date jumper 260. As a result, the date display is shifted from "30," which corresponds to "30th day," to "31," which corresponds to "31st day." The month end tooth 288 of the date indicator 220 is arranged at a position where it comes into contact with the month feeding operation portion 270C of the month feeding lever 270 or a position where it approaches the month feeding operation portion 270C of the month feeding lever 270.

Referring to FIG. 19B, when the date indicator driving wheel 210 further rotates, the date feeding finger 212 is arranged at a position where it comes into contact with the date indicator tooth portion 226 of the date indicator 220. The month end tooth 288 of the date indicator 220 is arranged at a position where it comes into contact with the month feeding operation portion 270C of the month feeding lever 270. The shorter month end feeding finger 286 of the shorter month end feeding lever 282 is arranged at a position where it is away from the month end tooth 288 of the date indicator 220.

Figure 19A:
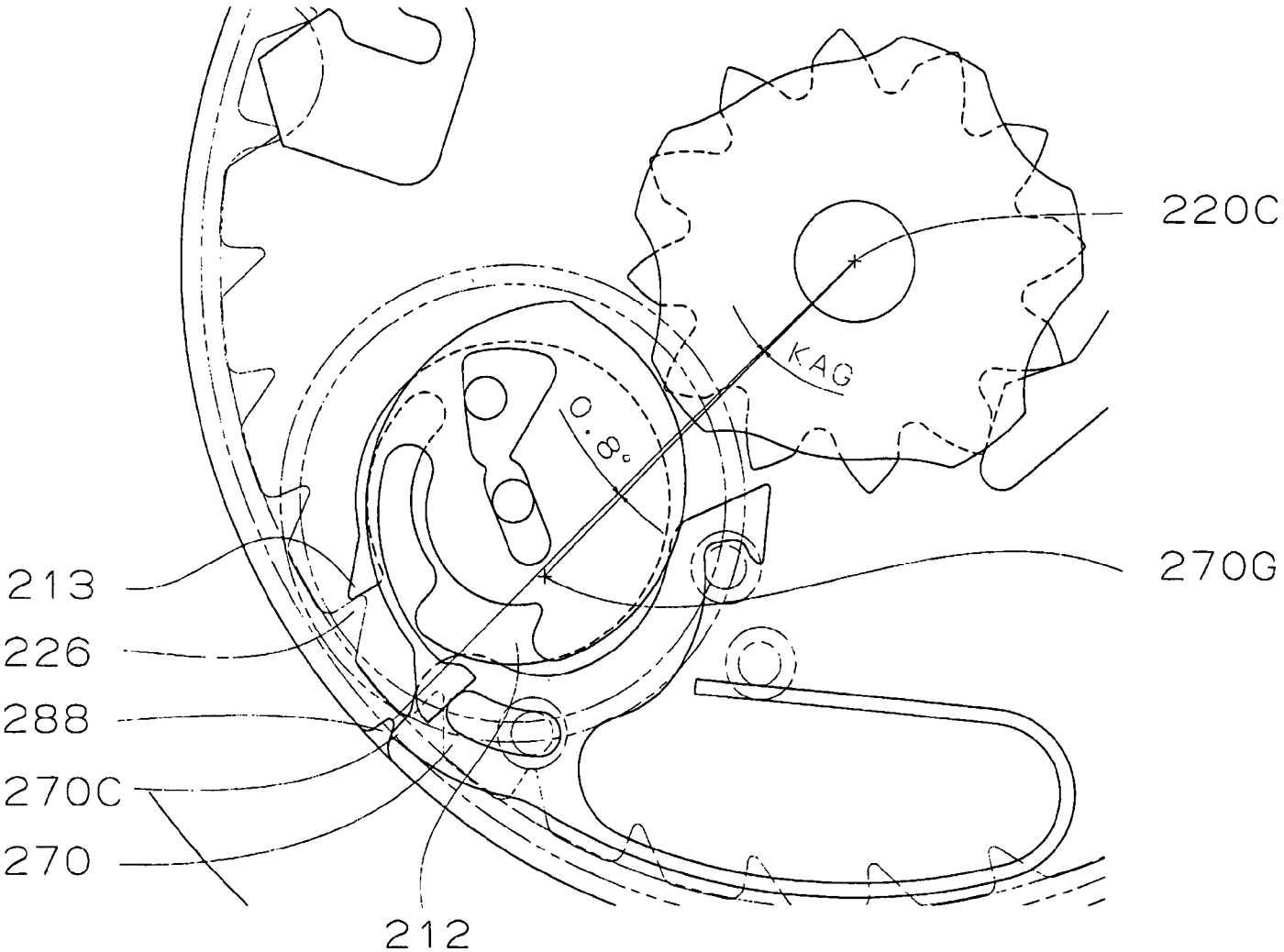
FIG. 19A is a partially enlarged plan view showing how a date feeding portion of the date feeding finger comes into contact with a tooth portion of a date indicator and a month end tooth comes into contact with a finger portion of a month feeding lever, with the month feeding lever starting to rotate.
Figure 19B:
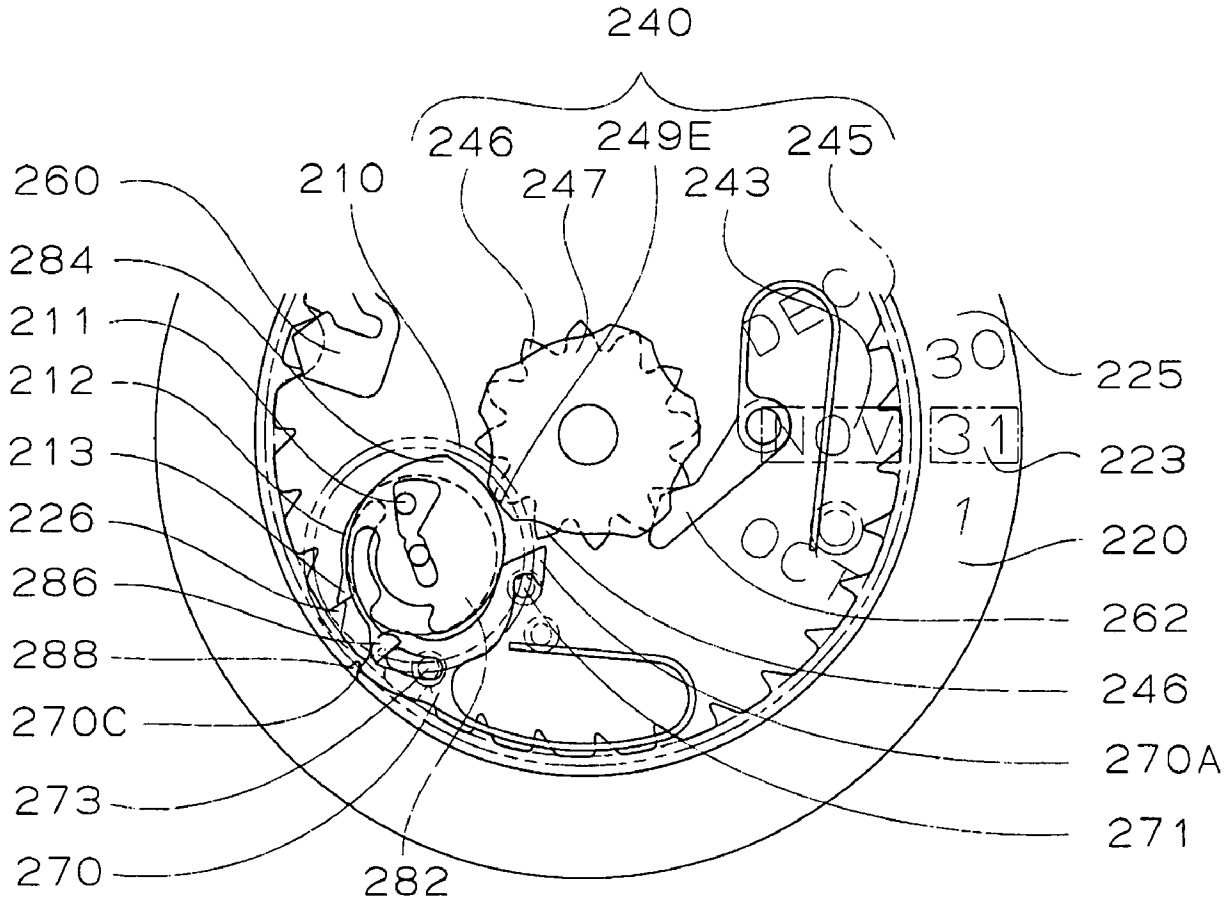
FIG. 19B is a partial plan view (4) showing the construction of a date feeding mechanism and a month feeding mechanism when the display changes from November 30 to December 1 in an embodiment of the watch with a calendar mechanism of the present invention.

FIG. 19A is a partially enlarged plan view showing how the date feeding portion of the date feeding finger comes into contact with the tooth portion of the date indicator and the month end tooth comes into contact with the finger portion of the month feeding lever, causing the month feeding lever to start rotating. Referring to FIG. 19A, the month feeding lever month end tooth position angle KAG, which is made by the straight line connecting the rotation center 220C of the date indicator 220 and the rotation center 270G of the month feeding lever 270, and the straight line connecting the rotation center 220C of the date indicator 220 (that is, the rotation center of the month indicator 240) and the distal end portion of the month end tooth 288, ranges preferably from 0 degree to ½ of the day regulating angle. In the state shown in FIG. 19A, the month feeding lever month end tooth position angle KAG is, for example, 0.8 degrees.

Figure 20A:
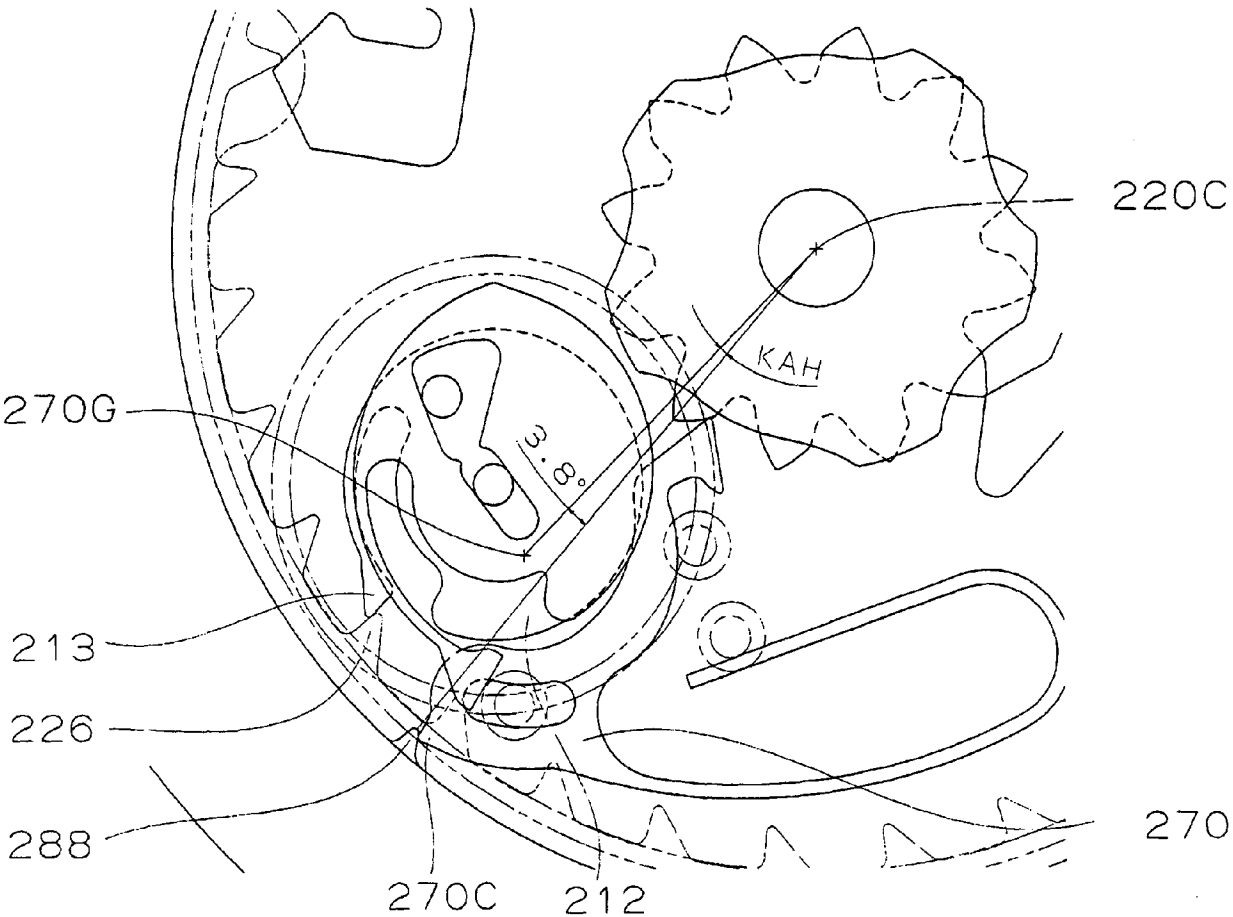
FIG. 20A is a partially enlarged plan view showing how a month end tooth causes a month indicator to rotate via a month feeding lever and the display is about to change to December 1 in an embodiment of the watch with a calendar mechanism of the present invention.
Figure 20B:
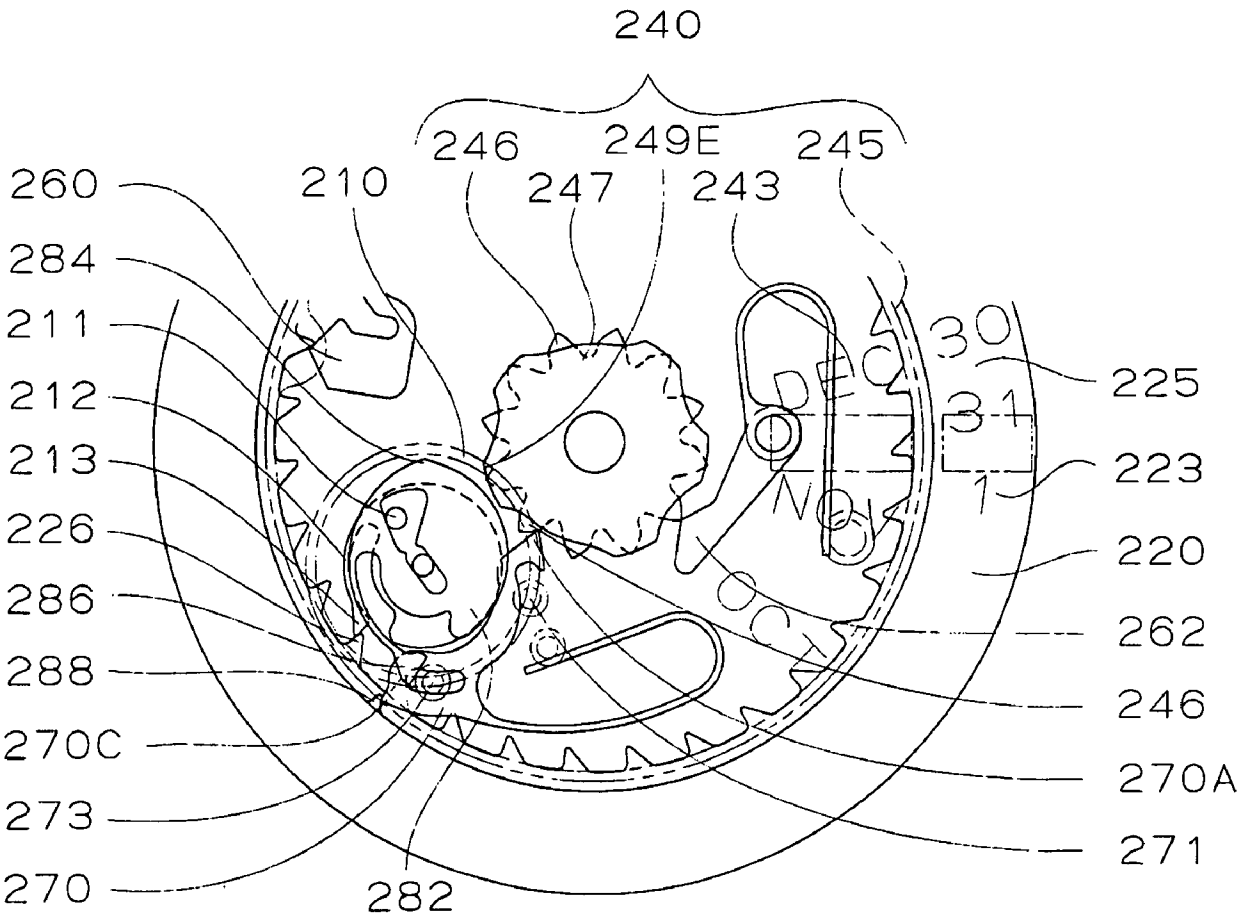
FIG. 20B is a partial plan view (5) showing the construction of a date feeding mechanism and a month feeding mechanism when the display changes from November 30 to December 1 in an embodiment of the watch with a calendar mechanism of the present invention.

Referring to FIGS. 20B and 26, when the date indicator driving wheel 210 further rotates, the date feeding finger 212 further rotates, and it is possible to rotate the date indicator tooth portion 226 of the date indicator 220 counterclockwise. The month end tooth 288 of the date indicator 220 moves the month feeding lever 270 toward the month wheel 242. The month feeding lever 270 moves toward the month star tooth portion 246 and comes into contact with the month feeding portion 270A, making it possible to rotate the month star tooth portion 246 of the month star 247 clockwise.

FIG. 20A is a partially enlarged plan view showing how the month end tooth rotates the month indicator via the month feeding lever, and transition to December 1 is about to be effected. Referring to FIG. 20A, the month feeding lever month end tooth position angle KAH, which is made by the straight line connecting the rotation center 220C of the date indicator 220 and the rotation center 270G of the month feeding lever 270, and the straight line connecting the rotation center 220C of the date indicator 220 (that is, the rotation center of the month indicator 240) and the distal end portion of the month end tooth 288, ranges preferably from 0 degree to ½ of the day regulating angle. In the state shown in FIG. 20A, it is desirable that the date indicator 220 be caused to undergo day regulating operation by the date jumper 260 and be about to be rotated to the next display, i.e., "1st day." That is, it is desirable that the value of the sum total of the month feeding lever month end tooth position angle KAG in the state shown in FIG. 19A and the month feeding lever month end tooth position angle KAH in the state shown in FIG. 20A be set to be smaller than the day regulating angle. In the state shown in FIG. 20A, the month feeding lever month end tooth position angle KAH is, for example, 3.8 degrees.

Figure 21:
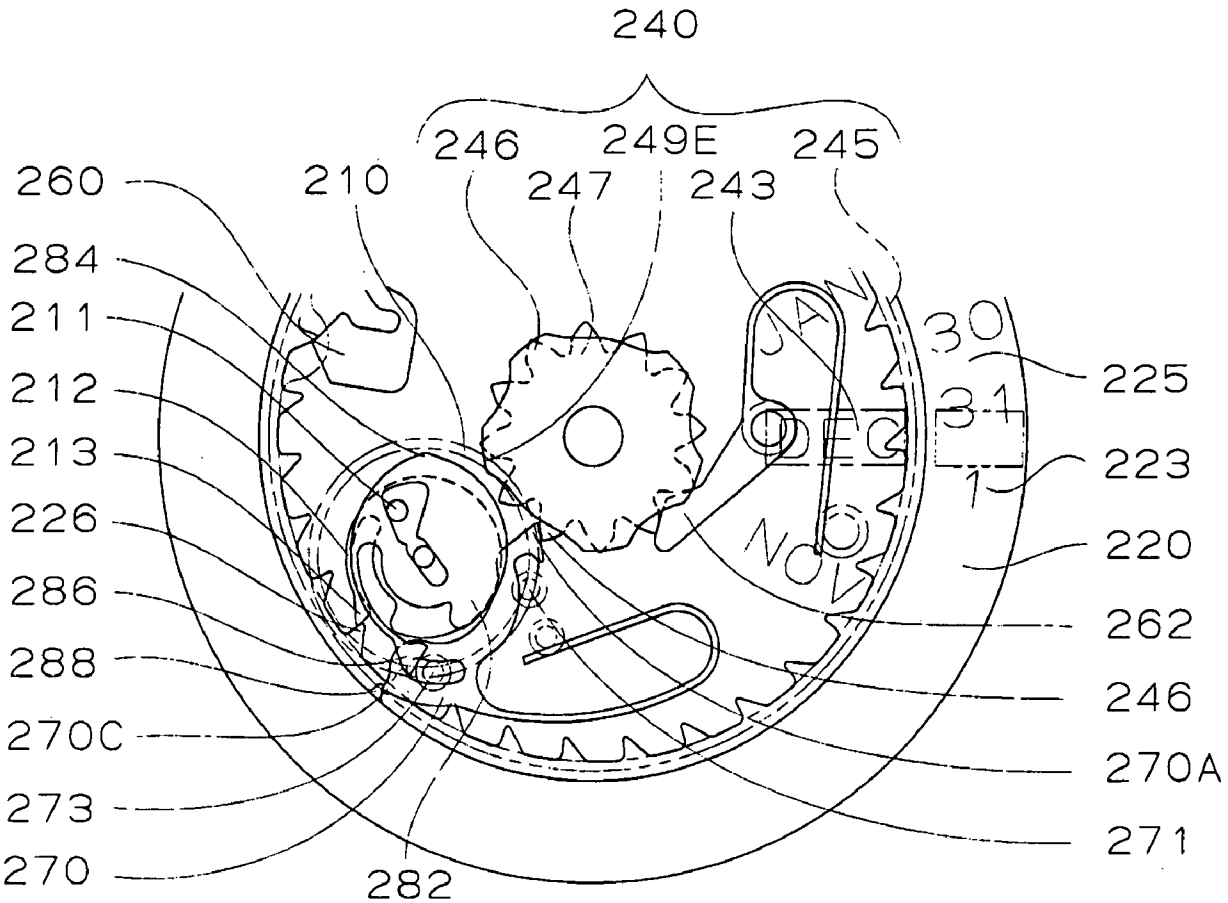
FIG. 21 is a partial plan view (6) showing the construction of a date feeding mechanism and a month feeding mechanism when the display changes from November 30 to December 1 in an embodiment of the watch with a calendar mechanism of the present invention.

Referring to FIGS. 21 and 26, when the date indicator driving wheel 210 further rotates, the date feeding finger 212 further rotates, and the date indicator tooth portion 226 of the date indicator 220 can be fed counterclockwise by only one tooth. The month end tooth 288 of the date indicator 220 moves the month feeding lever 270 toward the month wheel 242, and the month star tooth portion 246 of the month star 247 can be fed clockwise by only one tooth. The position of the month indicator 240 in the rotating direction after the month feeding operation is set by the month jumper 262. As a result, the month display is shifted from "NOV," which corresponds to "November," to "DEC," which corresponds to "December."

Figure 22:
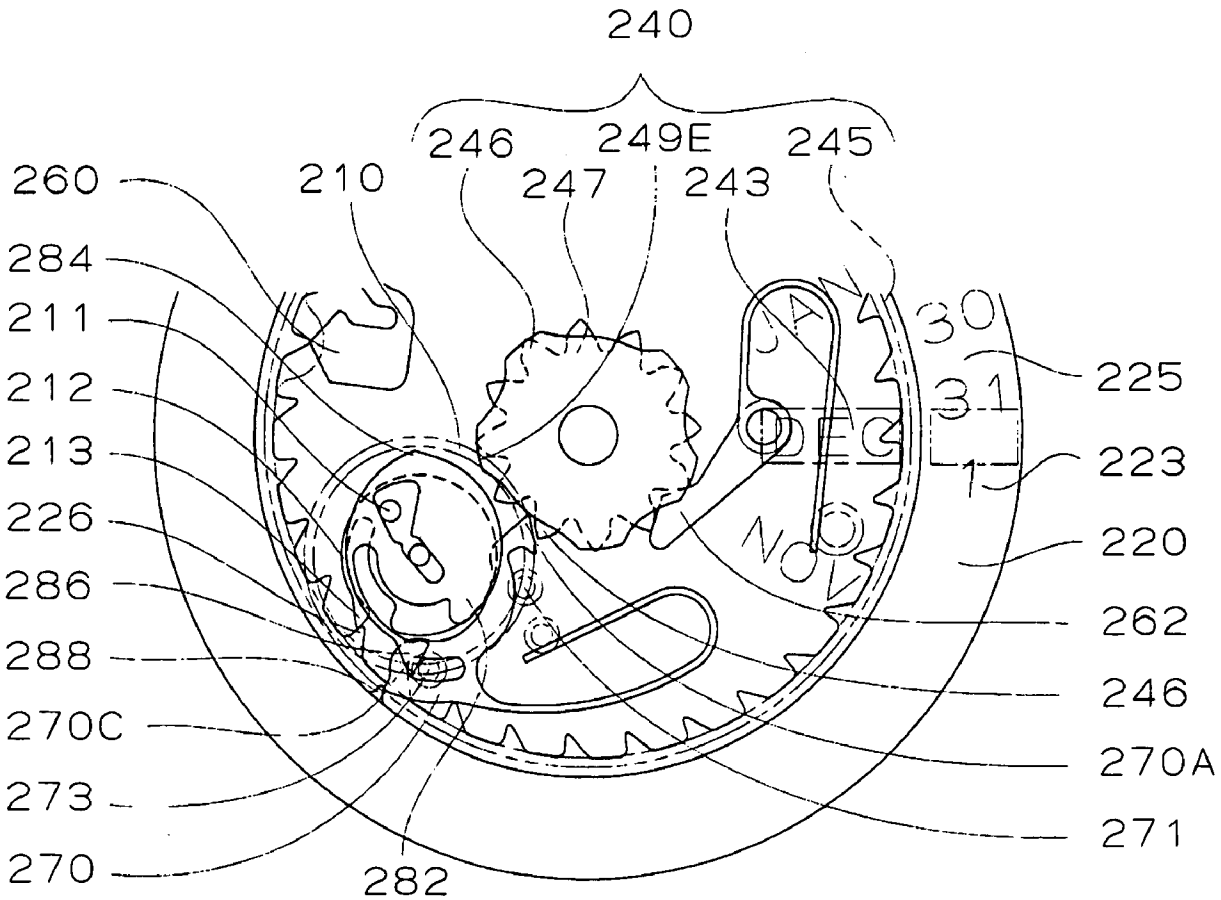
FIG. 22 is a partial plan view (7) showing the construction of a date feeding mechanism and a month feeding mechanism when the display changes from November 30 to December 1 in an embodiment of the watch with a calendar mechanism of the present invention.

Referring to FIG. 22, when the date indicator driving wheel 210 further rotates, the date feeding finger 212 further rotates, and the date indicator tooth portion 226 of the date indicator 220 can be rotated counterclockwise.

Figure 23:
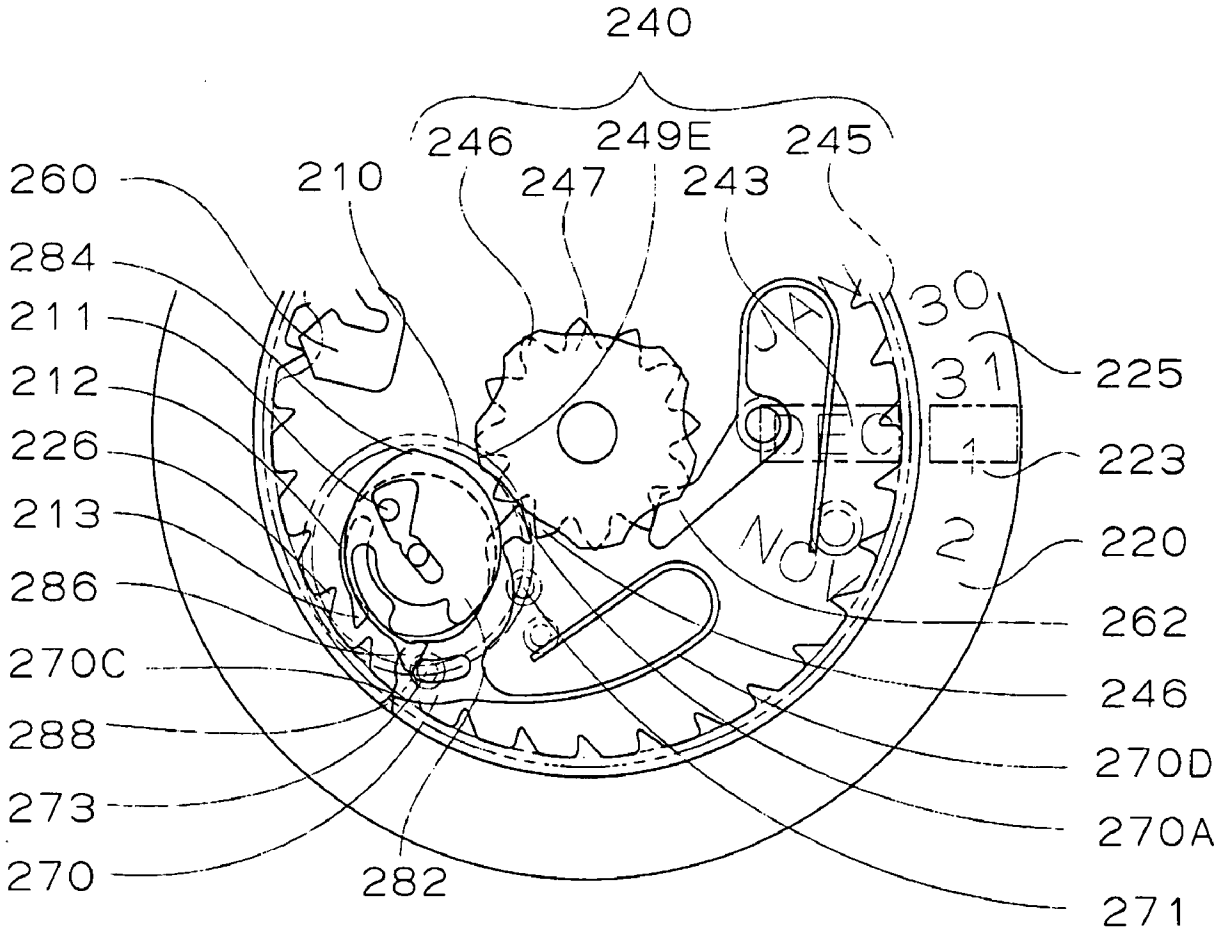
FIG. 23 is a partial plan view (8) showing the construction of a date feeding mechanism and a month feeding mechanism when the display changes from November 30 to December 1 in an embodiment of the watch with a calendar mechanism of the present invention.

Referring to FIG. 23, when the date indicator driving wheel 210 further rotates, the date feeding finger 212 further rotates, and the date indicator tooth portion 226 of the date indicator 220 can be fed counterclockwise. The position of the date indicator 220 in the rotating direction after the date feeding operation is set by the date jumper 260. The month end tooth 288 of the date indicator 220 is detached from the month feeding operation portion 270C of the month feeding lever 270. Due to the resilient force of the month feeding lever spring portion 270D, the month feeding lever 270 moves away from the month wheel 242. That is, the month feeding lever 270 moves toward the month indicator 240 based on the rotation of the date indicator 220, and is restored to the former position by the resilient force of the spring portion of the month feeding lever 270.

Figure 24:
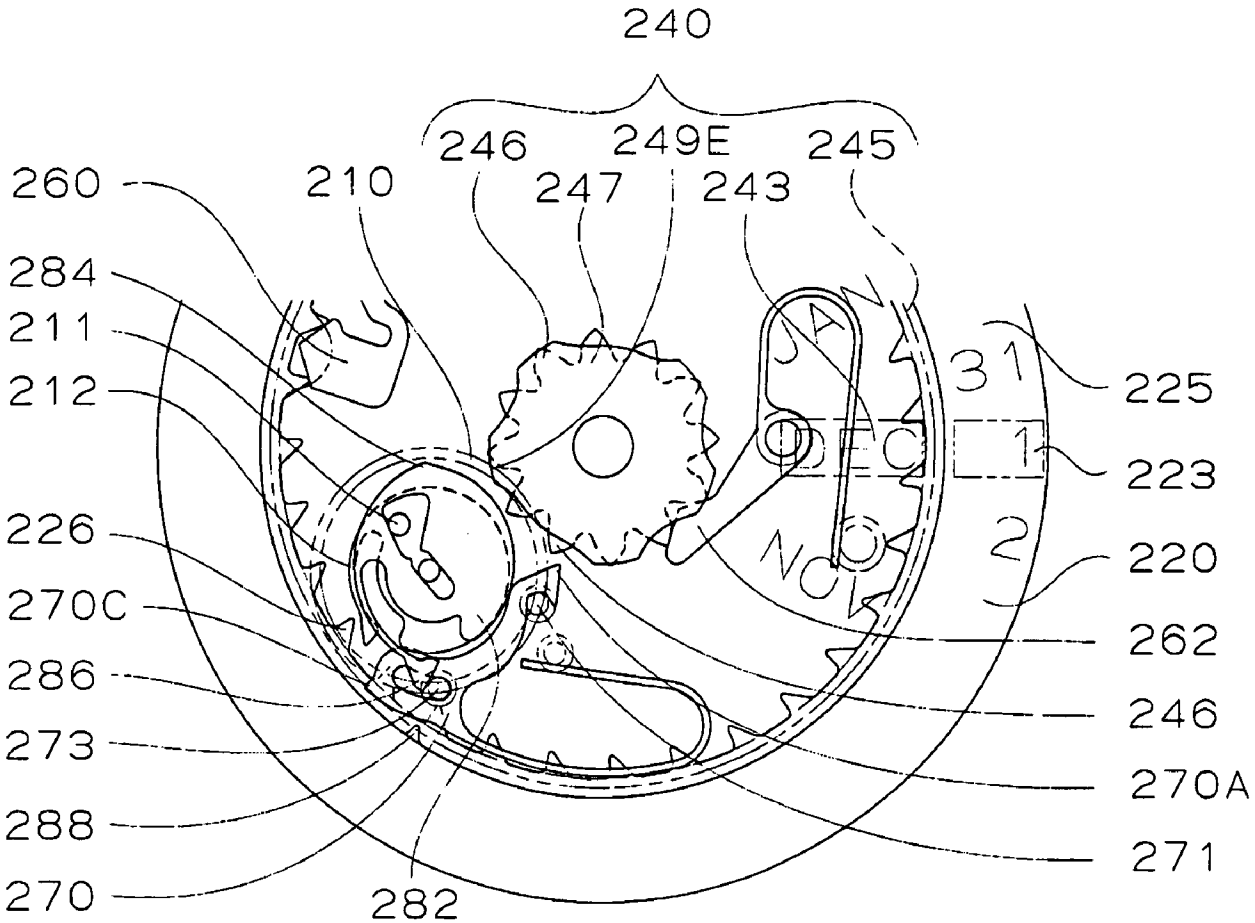
FIG. 24 is a partial plan view (9) showing the construction of a date feeding mechanism and a month feeding mechanism when the display changes from November 30 to December 1 in an embodiment of the watch with a calendar mechanism of the present invention.

Referring to FIG. 24, the date feeding finger 212 has fed the date indicator tooth portion 226 of the date indicator 220 counterclockwise by only one tooth, and the date display is changed to "1st day." Due to the movement of the month feeding lever 270 by the month end tooth 288 of the date indicator 220, the month star tooth portion 246 of the month star 247 has been fed clockwise by only one tooth, and the month display is changed to "DEC." The operations of date feeding and month feeding may be effected, for example, between 8 p.m. and 12 p.m.

The operation at the end of a "shorter month" other than "November" is the same as that at the end of "November." The operation at the end of "February" is the same as the operation at the end of "November," so that, at the end of "February" (on February 28 or February 29 in a leap year), it is necessary to effect date correction such that the date display is turned to "1," which corresponds to "1st day" using the calendar correction mechanism.

(8) Operation of the Watch when the Winding Stem is at the 0th Step

Referring to FIGS. 2 through 4 and FIG. 27, in the state in which the winding stem 110 is at the 0th step, the tooth B 114B of the clutch wheel 114 is in mesh with the inner tooth 116A of the winding pinion 116. Thus, when the winding stem 110 is rotated to the right (i.e., when the winding stem 110 is rotated clockwise as seen from the outer side of the watch), the winding pinion 116 rotates based on the rotation of the clutch wheel 114, and the crown wheel rotates. Based on the rotation of the crown wheel, the crown transmission wheel rotates. Through the rotation of the crown transmission wheel, the rocking crown wheel rocks while rotating and is engaged with the ratchet wheel, causing the ratchet wheel to rotate in a fixed direction. A click (not shown) is provided so as to prevent the ratchet wheel from rotating in the reverse direction.

A barrel arbor rotates based on the rotation of the ratchet wheel, winding up the mainspring. Due to the power of the mainspring, a barrel wheel rotates in a fixed direction. The front train wheel rotates based on the rotation of the barrel wheel, and the second hand and the minute hand constituting the time indicating members are rotated. The rotation speed of the front train wheel is adjusted by the governor device including the balance with hairspring and by the escapement device. Based on the rotation of the front train wheel, the back train wheel including the minute wheel and the hour wheel rotates, causing the hour hand to rotate. Further, based on the rotation of the back train wheel, the date feeding mechanism operates to rotate the date indicator 220, and the month feeding mechanism operates to rotate the month indicator 240.

Figure 4:
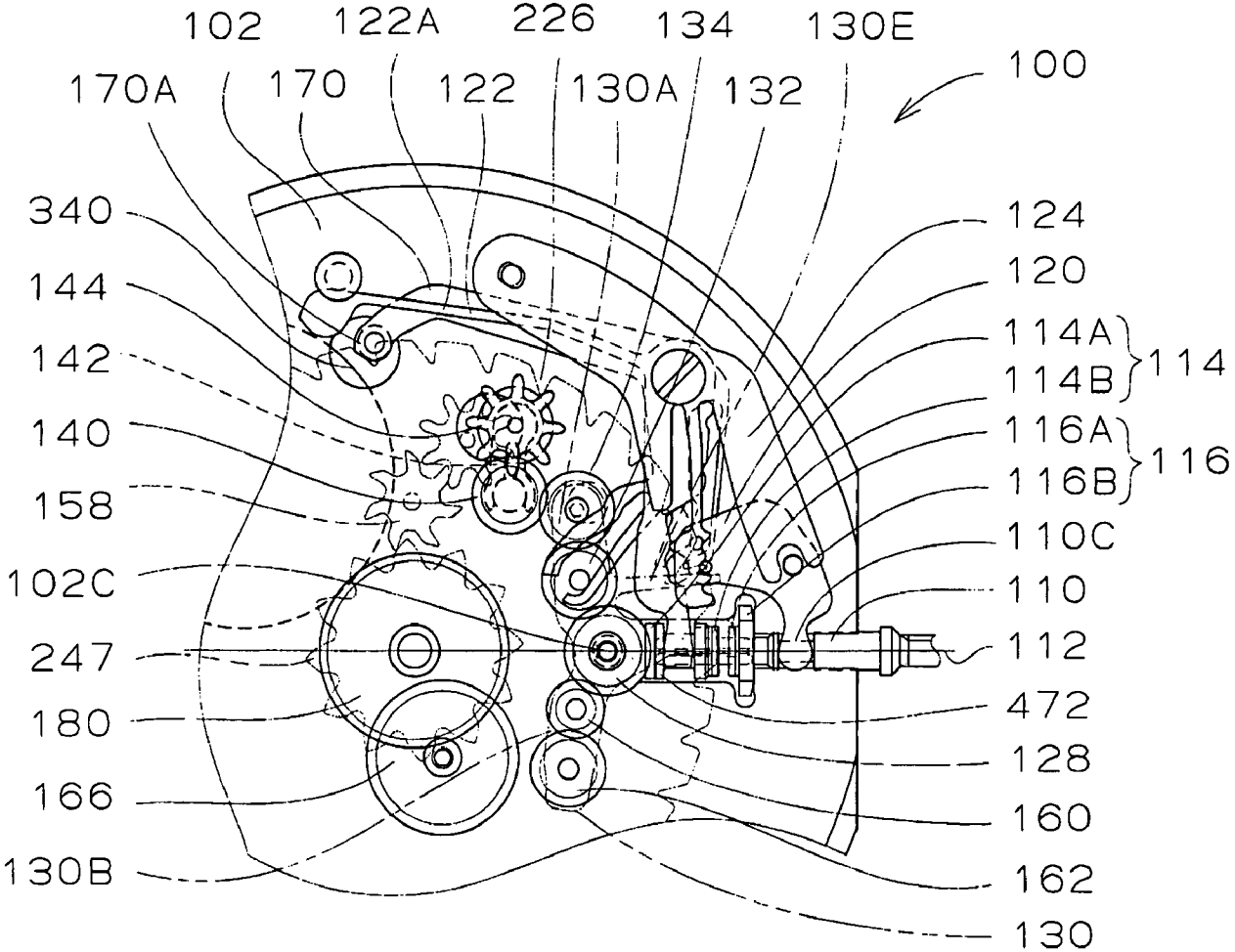
FIG. 4 is a partial plan view showing a calendar correction mechanism when the winding stem is at the 1st step in a first embodiment of the watch with a calendar mechanism of the present invention.

(9) Operation of the Watch when the Winding Stem is at the 1st Step (9.1) Date Correcting Operation:

Referring to FIG. 4, the winding stem 110 is pulled out by one step in the state in which it is at the 0th step, and the state in which the winding stem 110 is at the 1st step is attained. When the winding stem 110 is pulled out by one step, the setting lever 120 rotates counterclockwise, causing the yoke 122 to rotate clockwise. In this state, the tooth A 114A of the clutch wheel 114 is in mesh with the setting wheel 128, and the tooth B 114B of the clutch wheel 114 is not in mesh with the inner tooth 116A of the winding pinion 116.

As described above, when the winding stem 110 is at the 1st step, the balance setting lever 170 is rotated clockwise by the setting lever 120, and the rocking bar abutment portion of the balance setting lever 170 abuts the first correction transmission wheel shaft portion to thereby effect positioning. Due to the operation of the balance setting lever 170, the rocking bar 130 rotates counterclockwise, and the second correction transmission wheel shaft portion abuts the cylindrical wall surface of the rocking bar positioning hole. In this state, the balance setting lever 170 does not come into contact with the balance with hairspring 210.

When the winding stem 110 is rotated to the right (i.e., when the winding stem 110 is rotated clockwise as seen from the outer side of the watch), the setting wheel 128 rotates counterclockwise based on the rotation of the clutch wheel 114. Based on the rotation of the setting wheel 128, the first correction transmission wheel 132 rotates clockwise. Based on the rotation of the first correction transmission wheel 132, the second correction transmission wheel 134 rotates counterclockwise. Based on the rotation of the second correction transmission wheel 134, the third correction transmission wheel 140 rotates clockwise. Then, the rocking lever 142 rotates clockwise, and the correction wheel shaft portion abuts the cylindrical wall surface of the rocking lever positioning hole to thereby effect positioning. When, in this state, the winding stem 110 is rotated to the right, the third correction transmission wheel 140 can slip with respect to the rocking lever 142.

Based on the rotation of the third correction transmission wheel 140, the correction wheel 144 rotates counterclockwise at the position as shown in FIG. 4. Based on this rotation of the correction wheel 144*b*, the date indicator 150 rotates counterclockwise. The position of the date indicator 150 in the rotating direction is determined by the date jumper 180. As described above, in the watch of the present invention, the winding stem 110 is rotated to the right in the state in which the winding stem 110 is at the 1st step, thereby it is possible to effect date correction.

(9.2) Month Correcting Operation:

Referring to FIG. 4, in the state in which the winding stem 110 is at the 1st step, when the winding stem 110 is rotated to the left (i.e., when the winding stem 110 is rotated counterclockwise as seen from the outer side of the watch), the setting wheel 128 rotates clockwise based on the rotation of the clutch wheel 114. Based on the rotation of the setting wheel 128, the first correction transmission wheel 132 rotates counterclockwise. Based on the rotation of the first correction transmission wheel 132, the second correction transmission wheel 134 rotates clockwise. Based on the rotation of the second correction transmission wheel 134, the third correction transmission wheel 140 rotates counterclockwise. Then, the rocking lever 142 rotates counterclockwise, and the correction wheel shaft portion abuts the cylindrical wall surface of the rocking lever positioning hole to effect positioning. When, in this state, the winding stem 110 is rotated to the right, the third correction transmission wheel 140 can slip with respect to the rocking lever 142.

Based on the rotation of the third correction transmission wheel 140, the correction wheel 144 rotates clockwise. Based on this rotation of the correction wheel, the correction wheel 158 rotates counterclockwise. Then, based on the rotation of the correction wheel 158, the month indicator 180 rotates clockwise. The position of the month indicator 180 in the rotating direction is determined by the month jumper 262.

(10) Operation of the Watch when the Winding Stem is at the 2nd Step

Referring to FIG. 4, the winding stem 110 is further pulled out by one step from the 1st step to attain the state in which the winding stem 110 is at the 2nd step. When the winding stem 110 is further pulled out by one step, the setting lever 120 further rotates counterclockwise. During this operation, the yoke 122 does not rotate. Thus, in this state, in which the winding stem is at the 2nd step, as in the stage in which the winding stem 110 is at the 1st step, the tooth A 114A of the clutch wheel 114 remains in mesh with the setting wheel 128, and the tooth B 114B of the clutch wheel 114 is not in mesh with the inner tooth 116A of the winding pinion 116.

When the winding stem 110 is at the 2nd step, through rotation of the setting lever 120, the balance setting lever 170 is rotated counterclockwise, and the balance setting pin 170A of the balance setting lever 170 abuts the outer periphery of the balance wheel portion of the balance with hairspring 210, thereby stopping the rotation of the balance with hairspring 210. As a result, the pallet fork 342 and the escape wheel & pinion 330 do not operate, and the rotation of the second wheel & pinion 442 is set, with the rotation of the second hand 460 being stopped.

The balance setting pin 170A of the balance setting lever 170 may be formed by the end surface of the balance setting lever 170 or by bending the end surface of the balance setting lever 170 at right angles. Through rotation of the setting wheel 120, the pin provided at the distal end portion of the setting lever 120 pushes the setting lever engagement portion 130E of the rocking bar 130. Then, the rocking bar 130 rotates clockwise, and the second correction transmission wheel shaft portion abuts the cylindrical wall surface of the rocking bar positioning hole. Then, the second intermediate minute wheel 162 is engaged with the minute wheel 166.

When the winding stem 110 is rotated to the right (i.e., when the winding stem 110 is rotated clockwise as seen from the outer side of the watch), the setting wheel 128 rotates counterclockwise based on the rotation of the clutch wheel 114. Based on the rotation of the setting wheel 128, the first intermediate minute wheel 160 rotates clockwise. Based on the rotation of the first intermediate minute wheel 160, the second intermediate minute wheel 162 rotates counterclockwise. Based on the rotation of the second intermediate minute wheel 162, the minute wheel 166 rotates clockwise. Based on the rotation of the minute wheel 166, the hour wheel 180 and the center wheel & pinion 325 rotate counterclockwise. Thus, when the winding stem 110 is at the 2nd step, by rotating the winding step 110 to the right, it is possible to effect so-called "reverse hand matching."

When the winding stem 110 is rotated to the left (i.e., when the winding stem 110 is rotated counterclockwise as seen from the outer side of the watch), the setting wheel 128 rotates clockwise based on the rotation of the clutch wheel 114. Based on the rotation of the setting wheel 128, the first intermediate minute wheel 160 rotates counterclockwise. Based on the rotation of the first intermediate minute wheel 160, the second intermediate minute wheel 162 rotates clockwise. Based on the rotation of the second intermediate minute wheel 162, the minute wheel 166 rotates counterclockwise. Based on the rotation of the minute wheel 166, the hour wheel 250 and the minute wheel 260 rotate clockwise. Thus, when the winding stem 110 is at the 2nd step, by rotating the winding stem 110 to the left, it is possible to effect so-called "normal hand matching."

By rotating the hour wheel 180, it is possible to correct the "hour" display of the hour hand 464 mounted to the hour wheel 180. By rotating a cannon pinion of the minute wheel 446, it is possible to correct the "minute" display of the minute hand 462 mounted to the minute wheel 446. And, due to the operation of the balance setting lever 170, while the display of "hour" and "minute" is being corrected, the "second" display undergoes no change.

(11) Second Embodiment

Next, a second embodiment of the watch with a calendar mechanism of the present invention will be described. In the following, a difference between the second embodiment of the watch with a calendar mechanism of the present invention and the first embodiment of the watch with a calendar mechanism of the present invention will be mainly described. Thus, regarding the portions not described below, the description of those of the first embodiment of the watch with a calendar mechanism of the present invention applies here. The second embodiment of the watch with a calendar mechanism of the present invention is applied to an analog electronic watch. In the case in which the present invention is applied to an analog electronic watch, the construction and operation of the switching mechanism, the calendar feeding mechanism, and the calendar correction mechanism are the same as those of the first embodiment of the present invention described above.

Figure 28:
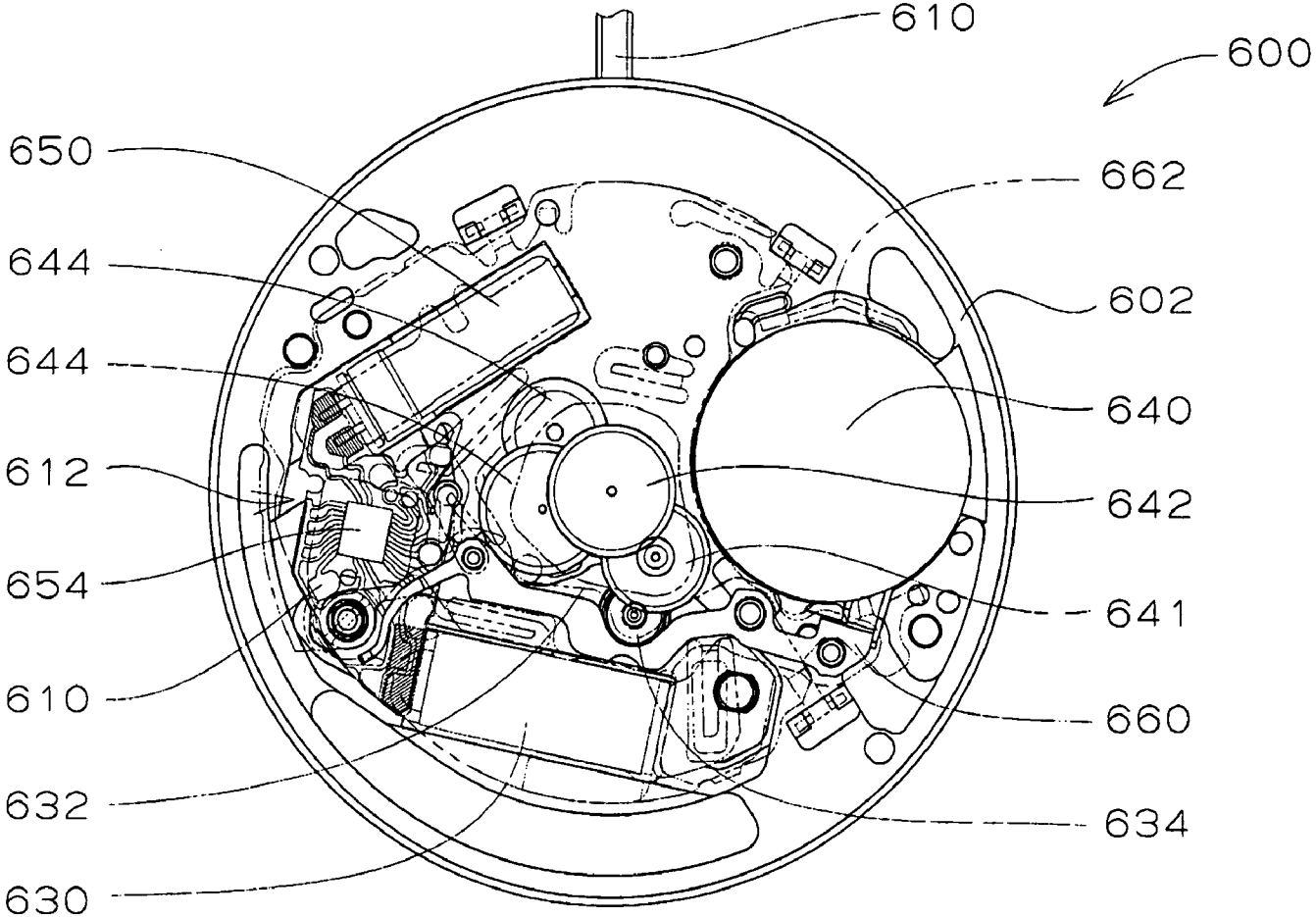
FIG. 28 is a schematic plan view showing the construction of a movement consisting of an electronic watch as seen from the case back side in a second embodiment of the watch with a calendar mechanism of the present invention.

Referring to FIG. 28, a movement 600 is formed by an analog electronic watch. The movement 600 includes a main plate 602 constituting the substrate of the movement. A dial (not shown) is mounted to the glass side of the movement 600. A winding stem 610 is rotatably incorporated into the main plate 602. The switching device includes the winding stem 610, a setting lever (not shown), a yoke (not shown), and a yoke holder (not shown). A setting device includes a setting lever (not shown). In the movement 600, a battery 640 constituting the power source of the watch is arranged on the case back side (front side) of the main plate 602. In the movement 600, it is desirable for the center of the battery 640 to be arranged between the "10 o'clock direction" and the "2 o'clock direction." In the movement 600, it is more desirable for the center of the battery 640 to be arranged between the "11 o'clock direction" and the "1 o'clock direction." A quartz unit 650 constituting the oscillation source of the watch is arranged on the case back side of the main plate 602. A quartz oscillator is accommodated in the quartz unit 650. A motor drive portion (driver) outputting a motor drive signal to a step motor based on the oscillation of the quartz oscillator is contained in an integrated circuit (IC) 654.

The quartz unit 650 and the integrated circuit 654 are fixed to a circuit board 610. The circuit board 610, the quartz unit 650, and the integrated circuit 654 constitute a circuit block 612. The circuit block 612 is arranged on the case back side of the main plate 602. A battery negative terminal 660 is provided for the purpose of establishing conduction between the cathode of the battery 640 and the negative pattern of the circuit board 610. A battery positive terminal 662 is provided for the purpose of establishing conduction between the anode of the battery 640 and the positive pattern of the circuit board 610. A coil block 630, a stator 632, and a rotor 634, which form the step motor, are arranged on the case back side of the main plate 602.

Through rotation of the rotor 634, a fifth wheel & pinion 641 rotates. Through the rotation of the fifth wheel & pinion 641, a second wheel & pinion 642 rotates. Through the rotation of the second wheel & pinion 642, a third wheel & pinion 644 rotates. Through the rotation of the third wheel & pinion 644, a center wheel & pinion (not shown) rotates. Through the rotation of the center wheel & pinion, a minute wheel 648 rotates. Through the rotation of the minute wheel 648, an hour wheel (not shown) rotates. An hour hand (not shown) is mounted to the hour wheel. The hour wheel makes one rotation in 12 hours. When the winding stem 610 is at the 0th step, and when the winding stem 610 is at the 1st step, the setting lever does not set the gear portion of the second wheel & pinion 642 or the fifth wheel & pinion 641. When the winding stem 610 is at the 2nd step, the setting lever sets the gear portion of the second wheel & pinion 642 or the fifth wheel & pinion 641.

The second wheel & pinion 642 makes one rotation in a minute. The center wheel & pinion makes one rotation in an hour. A slip mechanism is provided on the center wheel & pinion. When the winding stem 610 is pulled out to the 2nd step for hand matching, the setting lever (not shown) sets the gear portion of the second wheel & pinion 642 or the fifth wheel & pinion 641 to stop the rotation of the second hand. A center pipe (not shown) is fixed to the main plate 602. The center pipe extends from the case back side of the main plate 602 to the dial side of the main plate 602. A train wheel bridge (not shown) rotatably supporting the front train wheel is arranged on the case back side of the main plate 602.

On the back side of the movement 600, two date indicator driving wheels are rotated through rotation of the hour wheel, making it possible to operate a date feeding mechanism (not shown) and a month feeding mechanism (not shown). As seen in a sectional view, the date indicator driving wheel (not shown) arranged on the back side of the movement 600 is preferably arranged so as not to overlap the battery 640 arranged on the front side of the movement 600. The construction and operation of the date feeding mechanism and the month feeding mechanism are the same as the construction and operation of the date feeding mechanism and the month feeding mechanism of the first embodiment of the watch with a calendar mechanism of the present invention. Due to this construction, it is possible to realize an electronic watch with a calendar mechanism whose movement has a small thickness.

According to the present invention, it is possible to reduce the thickness of the date feeding mechanism and of the month feeding mechanism, making it possible to produce a watch with a calendar mechanism whose movement has a small thickness. Further, according to the present invention, it is possible to produce a watch with a calendar mechanism in which the operation of the date feeding mechanism and of the month feeding mechanism is stable. Further, according to the present invention, it is possible to produce a watch with a calendar mechanism in which no excessive load is applied to the transmission train wheel during usual date feeding.

What is claimed is:

1. A watch with a calendar mechanism equipped with a month indicator and a date indicator, the watch comprising:

a date indicator indicating date;

a month indicator rotating based on rotation of the date indicator to indicate month;

a date indicator driving wheel formed so as to make one rotation in 24 hours;

a date feeding finger formed so as to be capable of causing the date indicator to rotate based on the rotation of the date indicator driving wheel; and a shorter month end feeding lever formed so as to be capable of rotating the date indicator based on the rotation of the date indicator driving wheel and the rotation of the month indicator, wherein the date indicator includes a date indicating surface portion provided with a date letter, a date indicator tooth portion coming into contact with a date feeding portion of the date feeding finger, and a month end tooth for feeding the date indicator at the end of a month, wherein the month indicator includes a month indicating surface portion provided with a month letter, and a month cam for operating a shorter month end feeding lever at the end of a shorter month, wherein the month end tooth of the date indicator is arranged so as to be capable of coming into contact with the shorter month end feeding lever when the date letter indicates a month end, and wherein the shorter month end feeding lever is formed so as to be capable of feeding the date indicator by one day based on the rotation of the date indicator driving wheel and the rotation of the month cam at the end of a shorter month, wherein the watch further comprising a month feeding lever formed so as to be capable of moving based on the rotation of the date indicator to rotate the month indicator, with the month feeding lever being formed so as to be capable of feeding the month indicator at the end of a month.

2. A watch with a calendar mechanism according to claim 1, characterized in that the month feeding lever is formed so as to move toward the month indicator based on the rotation of the date indicator and to be restored to a former position by a resilient force of a spring portion of the month feeding lever.

3. A watch with a calendar mechanism according to claim 1, characterized in that the shorter month end feeding lever includes a month end feeding finger for feeding the date indicator at the end of a shorter month, the month end tooth being provided for the purpose of detecting a time when the date indicator indicates a "30th day", the month end tooth being provided on an inner side wall portion, the month end tooth of the date indicator being arranged so as to be capable of coming into contact with the shorter month end feeding finger when the date letter indicates the end of a month.

4. A watch with a calendar mechanism according to claim 1, characterized in that the shorter month end feeding lever is arranged on the upper side of the date feeding finger, and is formed so as to be movable with respect to the rotation center of the date indicator driving wheel.

5. A watch with a calendar mechanism according to claim 1, characterized in that the month end tooth is arranged on the inner side of the date indicating surface portion on the side nearer to the date indicator tooth portion than to the date indicating surface portion.

6. A watch with a calendar mechanism according to claim 1, characterized in that the date indicator driving wheel has a lever driving pin, the shorter month end feeding lever being formed so as to be rotatable by the lever driving pin and movable with respect to the month end tooth based on the rotation of the month indicator.

7. A watch with a calendar mechanism according to claim 1, characterized in that the shorter month end feeding lever is formed as a single plate.

8. A watch with a calendar mechanism according to claim 1, characterized in that the month end tooth is provided solely at one position of the date indicator, and is formed so as to be capable of a date feeding operation at the end of a shorter month and an operation of feeding the month indicator by the month end tooth.

* * * * *